US008899734B2

(12) United States Patent
Nozawa et al.

(10) Patent No.: US 8,899,734 B2
(45) Date of Patent: Dec. 2, 2014

(54) HOLDER, LIQUID ACCOMMODATION CONTAINER THAT IS ATTACHABLE TO AND DETACHABLE FROM HOLDER, AND LIQUID EJECTING APPARATUS

(75) Inventors: Izumi Nozawa, Matsumoto (JP); Hidetoshi Kodama, Matsumoto (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 380 days.

(21) Appl. No.: 13/224,285

(22) Filed: Sep. 1, 2011

(65) Prior Publication Data

US 2012/0056958 A1 Mar. 8, 2012

(30) Foreign Application Priority Data

Sep. 3, 2010 (JP) ..... 2010-197324

(51) Int. Cl.
*B41J 2/175* (2006.01)

(52) U.S. Cl.
CPC ..... *B41J 2/1752* (2013.01); *B41J 2/17553* (2013.01); *B41J 2/17566* (2013.01); *B41J 2/1753* (2013.01); *B41J 2/17513* (2013.01)
USPC ..... 347/86; 347/85

(58) Field of Classification Search
CPC .. B41J 2/1752; B41J 2/17553; B41J 2/17523; B41J 2/17503; B41J 2/17509; B41J 2/175
USPC ..... 347/84, 85, 86
See application file for complete search history.

(56) References Cited

U.S. PATENT DOCUMENTS 7,213,914 B2 5/2007 Anma et al.

FOREIGN PATENT DOCUMENTS

| | | | |
|---|---|---|---|
| JP | 2006-142483 | A | 6/2006 |
| JP | 2007-230248 | A | 9/2007 |
| JP | 2010-023458 | A | 2/2010 |

*Primary Examiner* — Jannelle M Lebron
(74) *Attorney, Agent, or Firm* — Kilpatrick Townsend & Stockton LLP

(57) ABSTRACT

Provided is a holder to which a liquid accommodation container can be attached or detached. The holder includes an apparatus side engagement portion, and an opposite wall surface portion. The opposite wall surface portion has a hole portion for inserting a protrusion portion provided in the back surface portion, and a guide groove for guiding the protrusion portion to the hole portion while restricting the movement of the protrusion portion relative to the width direction of the liquid accommodation container when the liquid accommodation container is mounted, the guide groove being extended upward from the hole portion in a usage posture of the holder.

19 Claims, 13 Drawing Sheets

IX, XA, XIA, XII
IVA
10
100
100a
100b
100b1
100b2
100b2a
100b3
100c
100d
100e
100f
110
112
114
120
122
122t
122u
124
130
140
160
160a
160b
160c
160e
160f
166w
170
170t
180
Wt
X
Y
Z

HOLDER, LIQUID ACCOMMODATION CONTAINER THAT IS ATTACHABLE TO AND DETACHABLE FROM HOLDER, AND LIQUID EJECTING APPARATUS

This application claims priority to Japanese Patent Application No. 2010-197324, filed Sep. 3, 2010, the entirety of which is incorporated by reference herein.

BACKGROUND

1. Technical Field

The present invention relates to a holder, a liquid accommodation container that is attachable to and detachable from the holder, and a liquid ejecting apparatus.

2. Related Art

A printer as an example of a liquid ejecting apparatus discharges ink from a printing head to a recording target (for example, a printing paper) to perform the printing. As a technology of supplying ink to the printing head, a technology of using an ink cartridge with ink accommodated therein is known (for example, JP-A-2006-142483). Specifically, by mounting the ink cartridge to the holder provided with the printing head, ink is supplied from the ink cartridge to the printing head.

In order for a user to be able to exchange the ink cartridge when the quantity of ink remaining in the ink cartridge becomes low, the holder is configured so that the ink cartridge can be attached thereto or detached therefrom. In some cases, the ink cartridge has a protrusion portion that is inserted into a hole portion of the holder so as to maintain the mounted state to the holder. In order to insert the protrusion portion into the hole portion of the holder, there is a need to attach the ink cartridge to the holder in the correct position. Herein, in JP-A-2006-142483, in order to attach the ink cartridge to the holder in the correct position, a partition wall is provided in the holder.

However, there is room for improvement in operability when attaching the ink cartridge to the holder. For example, when the partition wall is provided in the holder, since the ink cartridges are mounted in the state of being separated from each other, there is a problem in that the holder increases in size. Furthermore, depending on the attachment sequence, in some cases, a portion of the ink cartridge comes into contact with an inner wall surface of the holder before the ink cartridge is mounted, whereby the insertion of the ink cartridge is impeded.

Such a problem was common to a liquid accommodation container that is attachably and detachably mounted to a liquid ejecting apparatus, and a holder to which the liquid accommodation container can be attached or detected without being limited to the ink cartridge and the holder through the ink cartridge can be attached or detached.

JP-A-2007-230248 and JP-A-2010-23458 are examples of the above-described related art.

SUMMARY

Advantages of some aspects of the invention are to provide a technique of improving operability upon attaching the liquid accommodation container while promoting the miniaturization in a holder to which the liquid accommodation container can be attached or detached, and to provide a technology of improving operability upon being attached to the holder in a liquid accommodation container which is attachably and detachably mounted to the holder.

The invention can be realized as embodiments or applications as below.

Application Example 1

According to an aspect of the invention, there is provided a holder to which a liquid accommodation container can be attached or detached, the liquid accommodation container including a front surface portion as one wall surface forming a liquid accommodation chamber for accommodating liquid and a back surface portion facing the front surface as one wall surface and capable of storing liquid to be supplied to the outside, the holder includes an apparatus side engagement portion which is engaged with a container side restriction portion provided in the front surface portion; and an opposite wall surface portion which is disposed in a position facing the apparatus side engagement portion with a space capable of accommodating the liquid accommodation container interposed therebetween, the opposite wall surface portion has a hole portion for inserting a protrusion portion provided in the back surface portion; and a guide groove for guiding the protrusion portion to the hole portion while restricting the movement of the protrusion portion relative to the width direction of the liquid accommodation container when the liquid accommodation container is mounted, the guide groove being extended upward from the hole portion in a usage posture of the holder.

According to the holder described in the application 1, in the case of attaching the liquid accommodation container, a user can easily guide the protrusion portion of the liquid accommodation container to the hole portion of the holder by inserting the protrusion portion of the liquid accommodation container into the guide groove. Thus, it is possible to improve operability upon attaching the liquid accommodation container to the holder. Furthermore, since there is no need to provide a partition wall in the holder, a reduction in size of the holder can be promoted.

Application Example 2

In the holder according to the application 1, in the usage posture, the upper end of the guide groove may reach the upper end of the opposite wall surface portion.

According to the holder described in the application 2, since the guide groove reaches the upper end of the opposite wall surface portion, a user can more easily insert the protrusion portion of the liquid accommodation container into the guide groove. Thus, it is possible to further improve operability upon attaching the liquid accommodation container to the holder.

Application Example 3

In the holder according to the application 1 or 2, in the usage posture, the width of the upper end of the guide groove may be greater than that of a lower end of the guide groove.

According to the holder described in the application 3, since the width of the upper end of the guide groove is formed to be greater, a user can more easily insert the protrusion portion of the liquid accommodation container into the guide groove.

Application Example 4

In the holder according to any one of the application 1 to 3, the width of the guide groove may be monotonically decreased as it approaches the hole portion.

According to the holder described in the application 4, it is possible to accurately guide the protrusion portion toward the hole portion.

Application Example 5

In the holder according to any one of the application 1 to 4, the guide groove may have a tapered lower guide groove in which the width is gradually decreased as it approaches the hole portion.

According to the holder described in the application 5, a user can smoothly guide the protrusion portion of the liquid accommodation container to the hole portion due to the lower guide groove.

Application Example 6

In the holder according to any one of the application 1 to 5, in the usage posture, the lower end of the guide groove may have the same width as that of the hole portion.

According to the liquid accommodation container described in the application 6, it is possible to more smoothly guide the protrusion portion of the liquid accommodation container from the guide groove due to the hole portion.

Application Example 7

In the holder according to any one of the application 1 to 6, the hole portion may have approximately the same width as that of the protrusion portion of the liquid accommodation container.

According to the liquid accommodation container described in the application 7, it is possible to further restrict the movement of the liquid accommodation container relative to the holder after the protrusion portion is inserted into the hole portion.

Application Example 8

In the holder according to any one of the application 1 to 7, the opposite wall surface portion may have a deformation portion which is elastically deformable in a direction in which the apparatus side engagement portion and the opposite wall surface portion face each other, and the deformation portion may be formed in a groove bottom wall surface portion forming a bottom surface of the guide groove.

According to the liquid accommodation container described in the application 8, since the deformation portion is included, it is possible to reduce the possibility of the movement of the liquid accommodation container in the holder being limited before the liquid accommodation container is mounted to the holder.

Application Example 9

In the holder according to the application 8, in the usage posture of the holder, the lower end of the deformation portion reaches the hole portion.

According to the liquid accommodation container described in the application 9, it is possible to reduce the possibility of the movement of the liquid accommodation container being limited near the hole portion. Thus, it is possible to more reliably guide the protrusion portion of the liquid accommodation portion to the hole portion.

Application Example 10

In the holder according to the application 8 or 9, in the usage posture of the holder, before the protrusion portion of the liquid accommodation container among portions of the groove bottom wall surface portion is inserted into the hole portion, when the container side restriction portion of the liquid accommodation container is engaged with the apparatus side engagement portion, the upper end of the deformation portion reaches a position higher than an intersection point, in which a rotation trajectory of the protrusion portion due to the use of an engagement point, in which the liquid accommodation container is engaged, as a fulcrum, intersects the groove bottom wall surface portion.

According to the liquid accommodation container described in the application 10, before the protrusion portion is inserted into the hole portion, even when the container side restriction portion of the liquid accommodation container is engaged with the apparatus side engagement portion, it is possible to reduce the possibility of the movement of the liquid accommodation container being limited in the holder.

Application Example 11

In the holder according to any one of the application 8 to 10, the deformation portion may be formed by forming notches in both ends of the groove bottom wall surface portion.

According to the liquid accommodation container described in the application 11, it is possible to form the deformation portion through a simple configuration in which the notches are formed in both ends of the groove bottom wall surface portion.

Application Example 12

According to another aspect of the invention, there is provided a liquid accommodation container which is attachable to or detachable from a holder equipped in a liquid ejecting apparatus, the container includes a liquid accommodation chamber that accommodates liquid to be supplied to the liquid ejecting apparatus; a front surface portion that forms a wall surface of the liquid accommodation chamber; and a back surface portion that forms a wall surface of the liquid accommodation chamber and faces the front surface portion, wherein the front surface portion is provided with a container side restriction portion that is engaged with the holder, and the back surface portion is provided with a protrusion portion which is inserted into a hole portion provided in the opposite wall surface portion of the holder, the protrusion portion being guided by a guide groove provided in the holder for being guided to the hole portion while restricting movement in the width direction and being inserted into the hole portion.

According to the liquid accommodation container described in the application 12, it is possible to provide a liquid accommodation container that can easily guide the protrusion portion to the hole portion by being inserted into the guide groove.

Application Example 13

In the liquid accommodation container described in the application 12, in the mounted state of being mounted to the holder, an upper surface of the protrusion portion may come into contact with the hole portion.

According to the liquid accommodation container described in the application 13, it is possible to restrict the upward movement of the liquid accommodation container after being mounted to the holder.

Application Example 14

In the liquid accommodation container described in the application 12 or 13, in the mounted state of being mounted to the holder, the protrusion portion may restrict the movement of the liquid accommodation container relative to the holder in the width direction by cooperating with the hole portion.

According to the liquid accommodation container described in the application 14, it is possible to restrict the movement of the liquid accommodation container in the width direction after being mounted to the holder.

Application Example 15

According to still another aspect of the present invention, there is provided a liquid ejecting apparatus which includes the holder described in any one of the application 1 to 11; the liquid accommodation container mounted to the holder described in any one of the application 12 to 14; and a head which is provided with liquid accommodated in the liquid accommodation container and ejects the liquid toward the outside.

According to the liquid ejecting apparatus described in the application 15, it is possible to provide a liquid ejecting apparatus in which the operability upon attaching the liquid accommodation container to the holder is improved.

In addition, the invention can be realized in various forms and can be realized in the shape of a method of manufacturing the holder including any configuration mentioned above, a method of manufacturing the liquid accommodation container including any configuration mentioned above or the like, in addition to the configurations of the holder, the liquid accommodation container, and the liquid ejecting apparatus equipped with the holder and the liquid accommodation container mentioned above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order:

A. First Embodiment
B. Second Embodiment
C. Modified Example

A. First Embodiment

A-1. Configuration of Liquid Ejecting Apparatus

Figure 1:
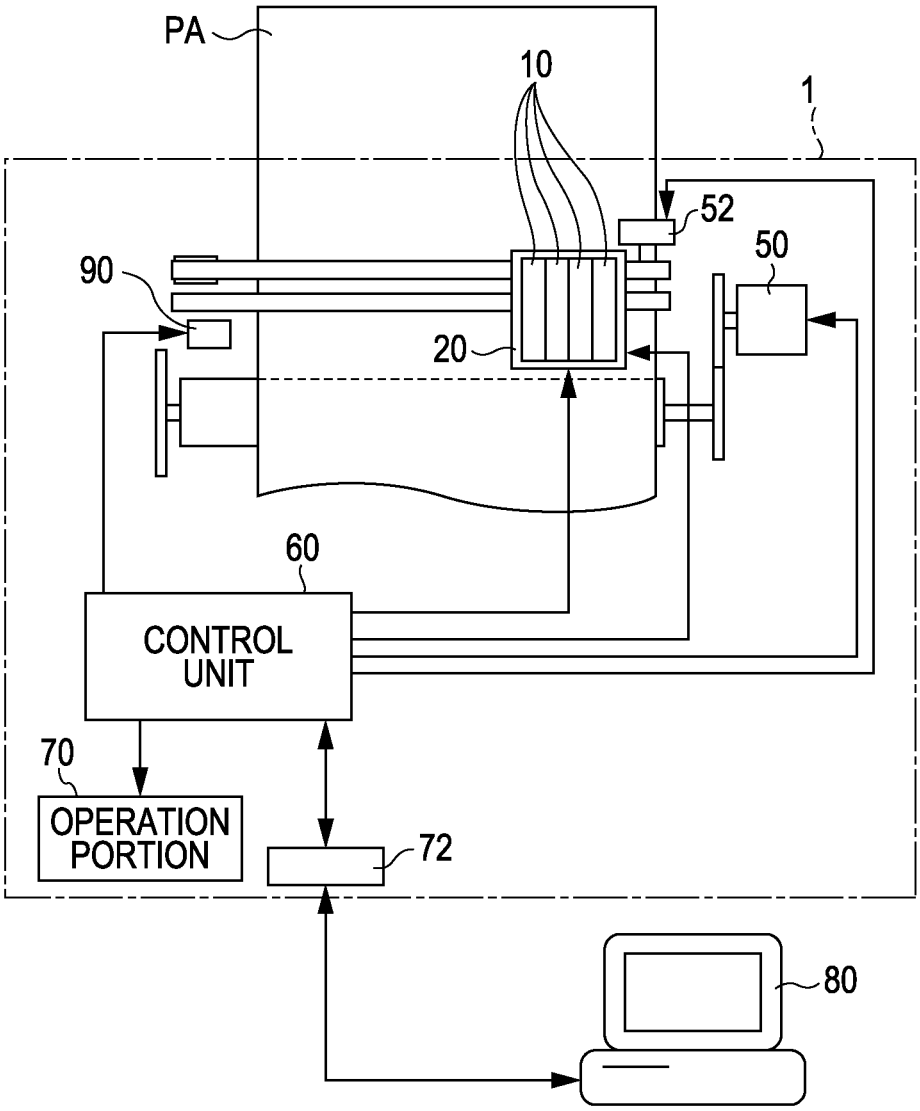
FIG. 1 is a diagram that shows a schematic diagram of a liquid ejecting apparatus.

FIG. 1 is a diagram that shows a schematic configuration of a liquid ejecting apparatus 1 including a liquid accommodation container 10 and a holder 20 as a first embodiment of the invention. The liquid ejecting apparatus 1 is an ink jet printer 1 (hereinafter, also referred to as a "printer 1") that discharges ink to a printing paper PA to perform printing. The printer 1 includes an ink cartridge 10 as a liquid accommodation container, a holder 20, a first motor 52, a second motor 50, a control unit 60, an operation portion 70, a predetermined interface 72, and an optical detection apparatus 90. In addition, hereinafter, the ink cartridge 10 is simply called the "cartridge 10".

The holder 20 includes a printing head (not shown) that discharges ink to a side facing the printing paper PA. Furthermore, the cartridge 10 is attachably and detachably mounted on the holder 20. In each cartridge 10, inks such as cyan, magenta, and yellow are accommodated, respectively. Ink accommodated in the cartridge 10 is supplied to the printing head of the holder 20 and ink is discharged onto the printing paper PA.

The first motor 52 drives the holder 20 in a main scanning direction. The second motor 50 transports the printing paper PA in a sub scanning direction. The control unit 60 controls the overall operation of the printer 1.

The optical detection apparatus 90 is fixed to a predetermined position. When the holder 20 is moved to a predetermined position, the optical detection apparatus 90 irradiates light toward the cartridge 10 so as to detect an quantity of ink remaining. In addition, the details will be described later.

The control unit 60 controls the first motor 52, the second motor 50, and the printing head performs the printing based on the printing data received from the computer 80 or the like connected via a predetermined interface 72. An operation portion 70 is connected to the control unit 60 and receives various operations from a user.

Figure 2:
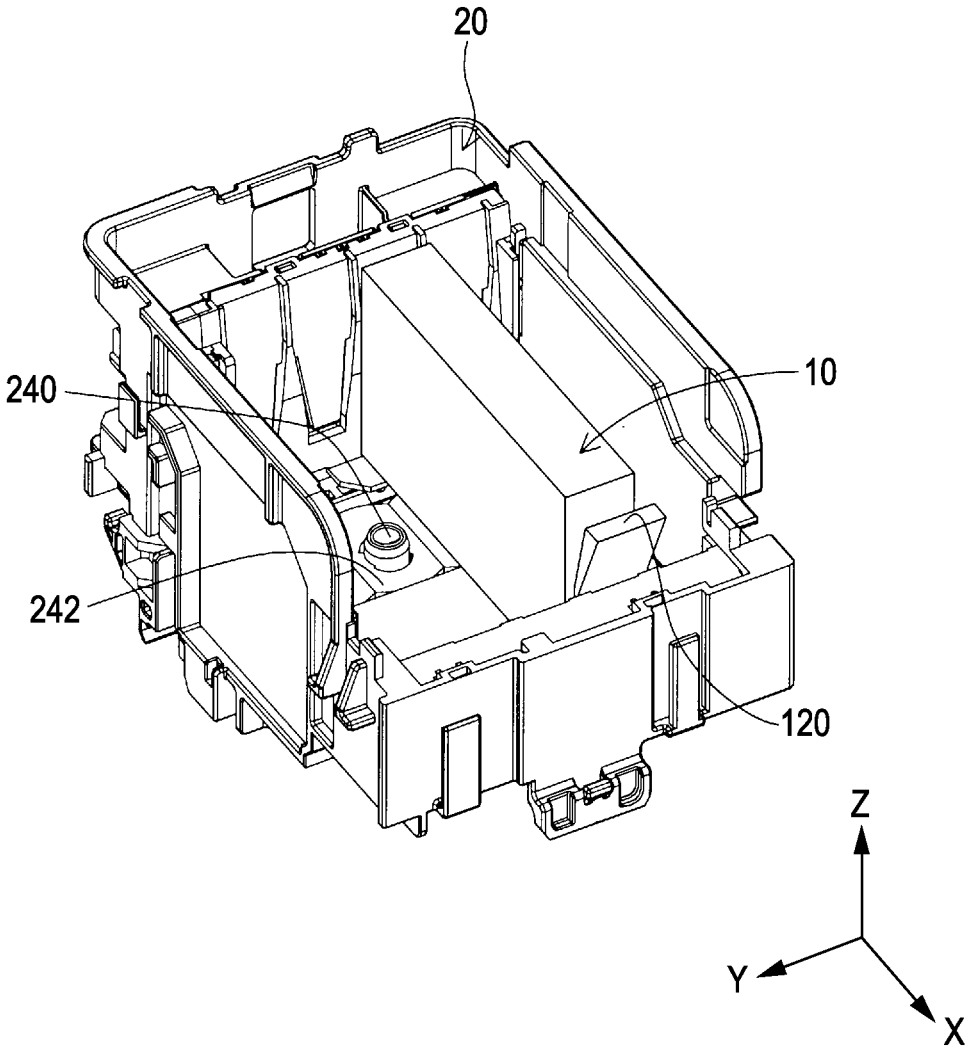
FIG. 2 is an exterior perspective view of a holder with a cartridge mounted thereto.

FIG. 2 is an exterior perspective view of the holder 20 with the cartridge 10 mounted thereto. FIG. 2 shows the state where one cartridge 10 is mounted to the holder 20 so as to facilitate the description. In addition, in FIG. 2, XYZ axes perpendicular to each other are attached so as to specify the direction. In the drawings shown later, XYZ axes perpendicular to each other are attached as necessary.

The holder 20 has a configuration to which four cartridges 10 can be mounted. In addition, the number of cartridges 10 which can be mounted to the holder 20 is not limited to four, but the configuration of the holder 20 can be changed depending on the number of cartridges 10 requiring the mounting. In the usage posture of the printer 1, the Z axis direction is the vertical direction, and the Z negative axis direction is a vertical down direction. Furthermore, the main scanning direction of the printer is a Y axis direction.

The holder 20 has a liquid supply pipe 240. The liquid supply pipe 240 causes the cartridge 10 to communicate with the printing head of the holder 20. Ink within the cartridge 10 is distributed to the printing head via the liquid supply pipe 240. Furthermore, an elastic member 242 for preventing ink from leaking out to the outside is provided around the liquid supply pipe 240. The cartridge 10 has a lever 120 as an elastic portion that is elastically deformed. A user can detach the cartridge 10 from the holder 20 by operating the elastic portion 120.

A-2. Configuration of Cartridge

Figures 3A, 3B, 3C, 3D:
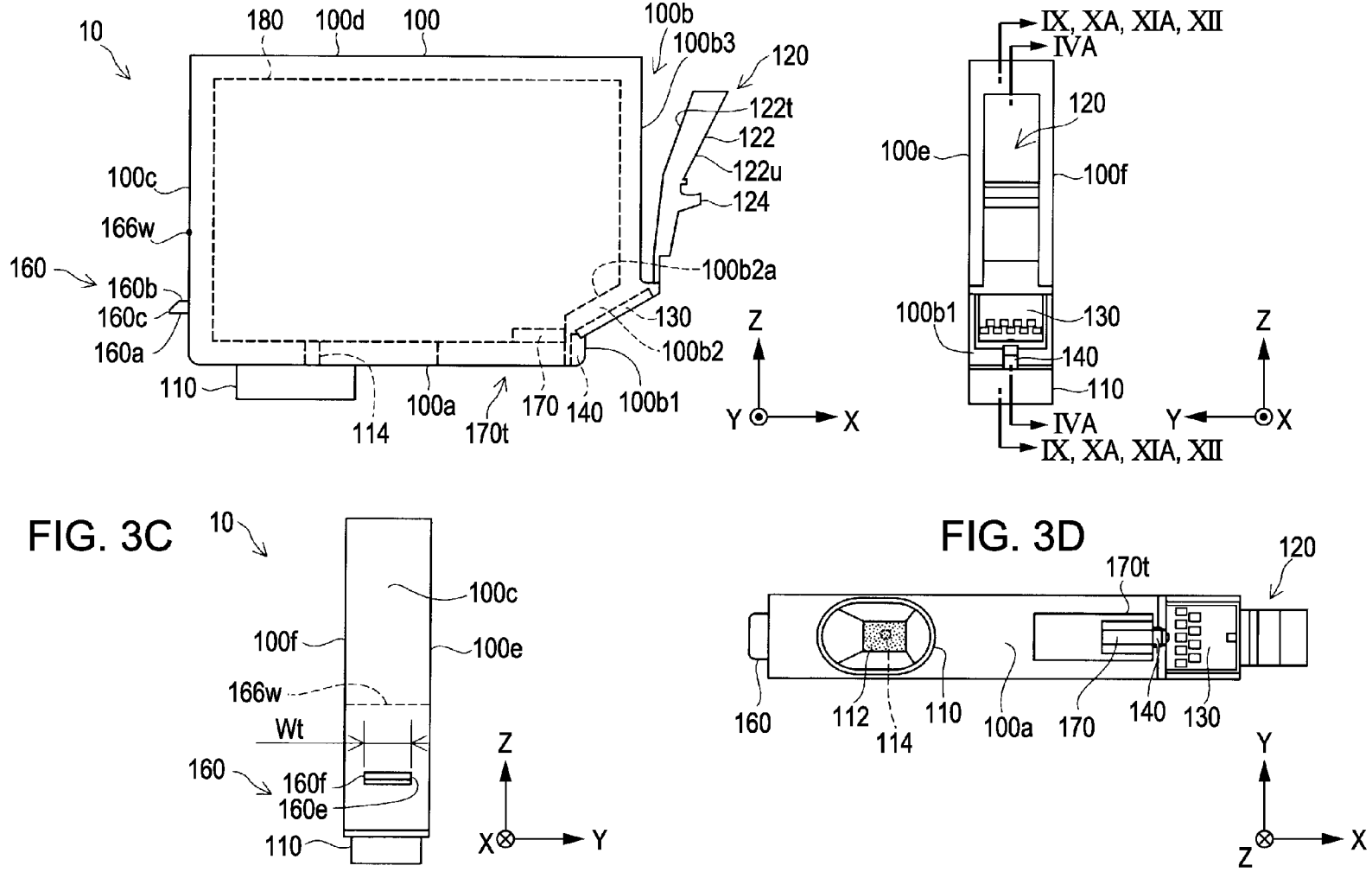
FIGS. 3A to 3D are first diagrams for describing the cartridge.
Figure 4A:
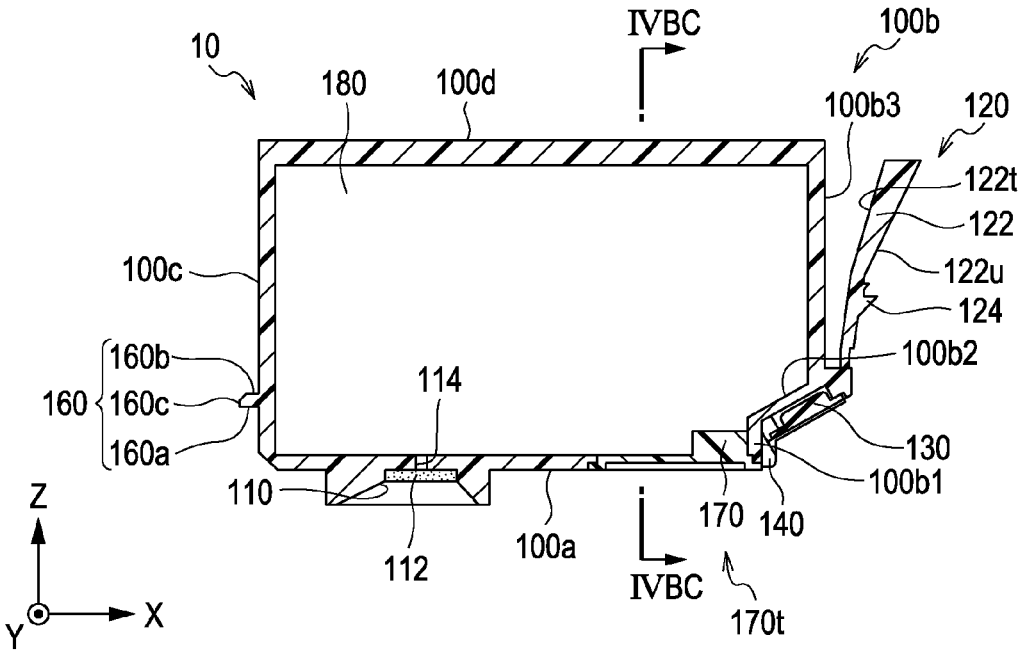
FIGS. 4A to 4C are second diagrams for describing the cartridge.
Figure 4B:
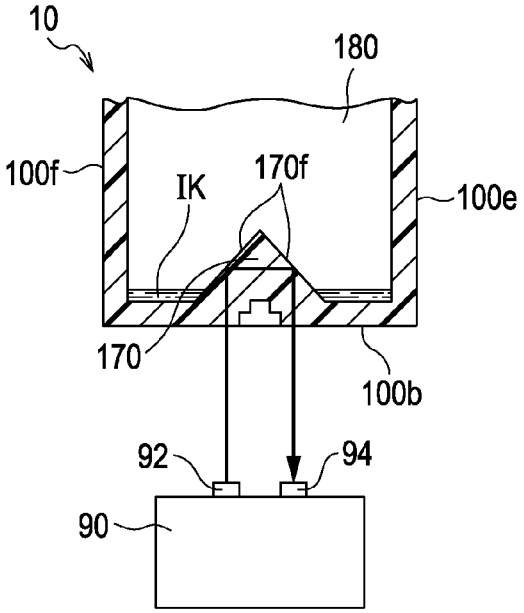
Figure 4C:
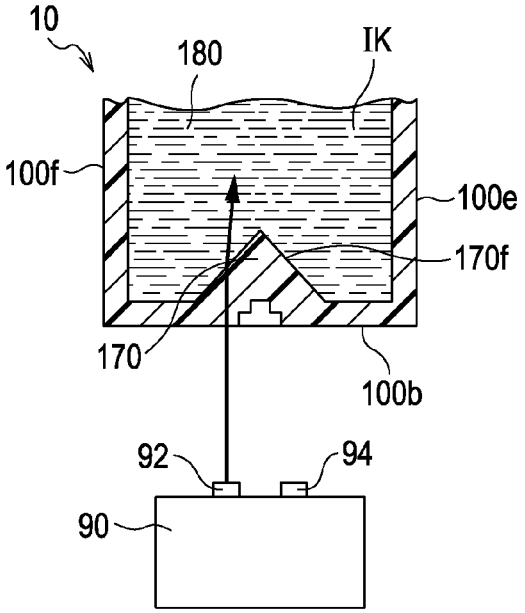

Next, the configuration of the cartridge 10 will be described using FIGS. 3A to 3D and 4A to 4C. FIGS. 3A to 3D are first diagrams for describing the cartridge 10. FIG. 3A is a side view of the cartridge 10. FIG. 3B is a front view of the cartridge 10. FIG. 3C is a rear view of the cartridge 10. FIG. 3D is a bottom view of the cartridge 10. FIGS. 4A to 4C are second diagrams for describing the cartridge 10. FIG. 4A is a cross-sectional view taken from line IVA-IVA of FIG. 3B. FIGS. 4B and 4C are diagrams for describing a detecting method of a quantity of ink remaining. In FIGS. 4B and 4C, the cartridge 10 with cross-section IVBC-IVBC of FIG. 4A is shown.

As shown in FIGS. 3A, 3B and 3D, the cartridge 10 includes a container main body 100, a lever 120, a liquid supply port 110, a circuit board 130, and a prism unit 170*t*. The container main body 100, the lever 120, and the liquid supply port 110 are formed of a synthetic resin such as polypropylene.

As shown in FIGS. 3A to 3D, the container main body 100 has a first wall surface portion (also called a "bottom surface portion") 100*a*, a second wall surface portion (also called a "front surface portion") 100*b*, a third wall surface portion (also called a "rear surface portion") 100*c*, a fourth wall surface portion (also called a "upper surface portion") 100*d*, a fifth wall surface portion (also called a "a left side surface portion") 100*e*, and a sixth wall surface portion (also called a "right side surface portion") 100*f*. The container main body 100 has a liquid accommodation chamber 180 for accommodating ink in an inner portion formed by the first to sixth wall surface portions 100*a* to 100*f* (FIG. 3A).

The first wall surface portion 100*a* is a wall surface portion of a Z negative axis direction side with respect to the liquid accommodation chamber 180. The second wall surface portion 100*b* is a wall surface portion of an X positive axis direction side with respect to the liquid accommodation chamber 180. The third wall surface portion 100*c* is a wall surface portion of an X negative axis direction side with respect to the liquid accommodation chamber 180. The fourth wall surface portion 100*d* is a wall surface portion of a Z positive axis direction side with respect to the liquid accommodation chamber 180. The fifth wall surface portion 100*e* is a wall surface portion of a Y positive axis direction side with respect to the liquid accommodation chamber 180. The sixth wall surface portion 100*f* is a wall surface portion of a Y negative axis direction side with respect to the liquid accommodation chamber 180. In addition, in regard to the cartridge 10, a direction (a Z axis direction), in which the first wall surface portion 100*a* faces the fourth wall surface portion 100*d*, is a height direction. Furthermore, a direction (an X axis direction), in which the second wall surface portion 100*b* faces the third wall surface portion 100*c*, is a length direction. Furthermore, a direction (a Y axis direction), in which the fifth wall surface portion 100*e* faces the sixth wall surface portion 100*f*, is the width direction.

The inner surface and the outer surface of the first wall surface portion 100*a* have an approximately rectangular bottom surface in the posture of being mounted to the holder 20. The fourth wall surface portion 100*d* is a wall surface portion facing the first wall surface portion 100*a*, and the inner surface and the outer surface thereof constitute an approximately rectangular upper surface in the mounting posture. The outer surfaces of the first and fourth wall surface portions 100*a* and 100*d* are horizontal surfaces in the mounting posture.

As shown in FIGS. 3A to 3D, the second, third, fifth and sixth wall surface portions 100*b*, 100*c*, 100*e*, and 100*f* are connected to each sides (four sides) of the first and fourth wall surface portions 100*a* and 100*d*, respectively. Among them, the third, fifth and sixth wall surface portions 100*c*, 100*e* and 100*f* perpendicularly intersect the first and fourth wall surface portions 100*a* and 100*d*. That is, the outer surfaces of each wall surface portions 100*c*, 100*e* and 100*f* are in a vertical relationship with the horizontal surface in the mounting posture. The second wall surface portion 100*b* and the third wall surface portion 100*c* face each other. Furthermore, the fifth wall surface portion 100*e* and the sixth wall surface portion 100*f* face each other.

As shown in FIG. 3A, the second wall surface portion 100*b* has a first vertical wall portion 100*b*1, a sloping wall portion 100*b*2, and a second vertical wall portion 100*b*3. In the mounting posture, the first vertical wall portion 100*b*1 is situated in vertically lowest portion of the portion of the second wall surface portion 100*b* and stands up vertically upward from the first wall surface portion 100*a*. The second vertical wall portion 100*b*3 is situated in the vertically uppermost portion of the portion of the second wall surface portion 100*b* and is in a vertical relationship with the fourth wall surface portion 100*d*. One end portion of the sloping wall portion 100*b*2 is connected to the first vertical wall portion 100*b*1 and the other end portion is connected to the second vertical wall portion 100*b*3. The sloping wall portion 100*b*2 inclines so as to cause ink near the second wall surface portion 100*b* of the liquid accommodation chamber 180 to flow toward the liquid supply port 110. That is, the sloping wall portion 100*b*2 has an inner surface 100*b*2*a* which inclines from one end portion as the upper end toward the other end portion as the lower end in a direction approaching the liquid supply port 110. In addition, the outer surface of the sloping wall portion 100*b*2 also inclines similar to the inner surface 100*b*2*a*.

As shown in FIG. 3A, in the first wall surface portion 100*a*, the liquid supply port 110 is provided which distributes ink of the liquid accommodation chamber 180 toward the outside. The liquid supply port 110 is provided in a portion closer to the third wall surface portion 100*c* than the second wall surface portion 100*b* among the portion of the first wall surface portion 100*a*. The liquid supply port 110 communicates with a distribution flow path 114 formed in the first wall surface portion 100*a* and distributes ink within the liquid accommodation chamber 180 toward the outside (in the present embodiment, the printing head). As shown in FIGS. 3D and 4A, sponge-like foam 112 is disposed in the liquid supply port 110, and prevents ink from leaking out from the liquid supply port 110.

As shown in FIGS. 3A, 3D and 4A, in the first wall surface portion 100*a*, a prism unit 170*t* is disposed. The prism unit 170*t* is formed in a transparent shape from polypropylene. As shown in FIGS. 4A to 4C, the prism unit 170*t* has a prism 170 for being used in an quantity of ink remaining detector. The prism 170 has an isosceles right-angle triangular shape and is disposed so that a reflection surface 170*f* (FIGS. 4B and 4C) is situated in the liquid accommodation chamber 180. Furthermore, as shown in FIG. 4A, the prism 170 is disposed in contact with the inner surface of the second wall surface portion 100*b* (specifically, the first vertical wall portion 100*b*1). By disposing the prism in this manner, it is possible to prevent the ink directed from the second wall surface 100*b* to the liquid supply port 110 from being dammed by the prism 170. As a result, it is possible to reduce the quantity of ink remaining staying in the liquid accommodation chamber 180, which can effectively consume ink.

The prism 170 differs in reflection state of light depending of the refractive index of fluid coming into contact with the reflection surface 170*f*. As shown in FIG. 4B, when the quantity of ink remaining is reduced to the extent that the reflection surface 170*f* comes into the air, due to the difference in refractive index between the prism 170 and air, light irradiated from a light emitting element 92 is reflected by the reflection surface 170*f* of the prism 170 and is incident to a light reception element 94. Meanwhile, as shown in FIG. 4C, when ink exists in the liquid accommodation chamber 180 to the extent that the reflection surface 170*f* comes into contact with ink IK, since the refractive index of the prism 170 and ink are identical to each other, light irradiated from the light emitting element 92 is slightly refracted by the reflection surface 170*f* and goes straight in the ink IK. That is, by measuring light that is incident to the light reception element 94, the quantity of ink remaining can be detected.

As shown in FIGS. 3A, 3B and 4A, in the first vertical wall portion 100*b*1 of the second wall surface portion 100*b*, a notch (groove) 140 is formed. As shown in FIG. 3B, the notch 140 is provided at the approximate center of the first vertical wall portion 100*b*1 in the width direction.

As shown in FIGS. 3A and 4A, the circuit board 130 is provided in the sloping wall portion 100*b*2 of the second wall surface portion 100*b*. As shown in FIG. 3A, in regard to the length direction (the X axis direction), the circuit board 130 is disposed so as to partially overlap with the notch 140. That is, in the mounted state where the cartridge 10 is mounted to the holder 20, the circuit board 130 is situated vertically above the notch 140. Furthermore, in other words, in the case of vertically projecting the cartridge 10 in the vertical direction (the Z axis direction), the circuit board 130 is disposed so as to partially overlap with the notch 140. The circuit board 130 is electrically connected to the control unit 60 (FIG. 1) of the printer 1 upon being mounted to the holder 20, whereby various information (signal) is transmitted between the circuit board 130 and the printer 1. In addition, the detail of the circuit board 130 will be described later.

As shown in FIGS. 3A and 4A, the lever 120 is provided in the second wall surface portion 100*b*. Specifically, a lower end surface of the lever 120 is mounted to the sloping wall portion 100*b*2. Furthermore, the lever 120 is extended upward from the lower end surface. The lever 120 has elasticity, and is elastically deformed by the external force in the length direction (X axis direction). The lever 120 has a container side restriction portion 124, and an engagement release portion 122. The container side restriction portion 124 is engaged with the holder 20 described later and restricts the movement of the cartridge 10 in the height direction. Specifically, the container side restriction portion 124 restricts the movement of the second side wall portion 100*b* side in the height direction. The engagement release portion 122 is a portion to which the external force is applied by a user, and is used so as to release the engagement of the holder 20 with the container side restriction portion 124. The engagement release portion 122 has a first side surface 122*t* facing the second wall surface portion 100*b*, and a second side surface 122*u* of the opposite side to the first side surface 122*t*. When the first side surface 122*t* comes into contact with the second wall surface portion 100*b*, the second side surface 122*u* inclines so as to approach a rotation fulcrum 166*w* described later as it goes from the upper end to the lower end. Hereinafter, the inclination of the second side surface 122*u* in this direction is also called a "lower inclination".

As shown in FIGS. 3A, 3C and 4A, among the portion of the third wall surface portion 100*c*, in a portion occupying equal to or less than half in the height direction, a protrusion portion 160 is provided. In the mounting posture, the protrusion portion 160 has a bottom surface 160*a*, an upper surface 160*b*, a tip surface 160*c*, and first and second side surfaces 160*e* and 160*f*. The protrusion portion 160 is used so as to restrict the movement of the cartridge 10 relative to the holder 20 after the cartridge 10 is mounted to the holder 20. Specifically, the protrusion portion 160 restricts the movement of the cartridge 10 in the width direction and the height direction of the third wall surface portion 100*c* side in cooperation with the holder 20. The protrusion portion 160 has a width Wt (FIG. 3C). In addition, the restricting method of the movement of the cartridge 10 using the protrusion portion 160 will be described later.

Furthermore, as shown in FIGS. 3A and 3C, the third wall surface portion 100*c* has a rotation fulcrum 166*w* which comes into contact with the holder 20 and becomes the fulcrum of the rotation when detaching the cartridge 10 from the holder 20. The rotation fulcrum 166*w* is situated in the lower portion than the engagement point where the container side restriction portion 124 is engaged with the holder 20 in regard to the height direction. In other words, the rotation fulcrum 166*w* is situated in the lower portion than the engagement release portion 122 in regard to the height direction. Furthermore, in the third wall surface portion 100*c*, an atmosphere opening hole (not shown) for introducing air into the inner portion according to the consumption of ink of the liquid accommodation chamber 180 is formed.

Figure 5A:
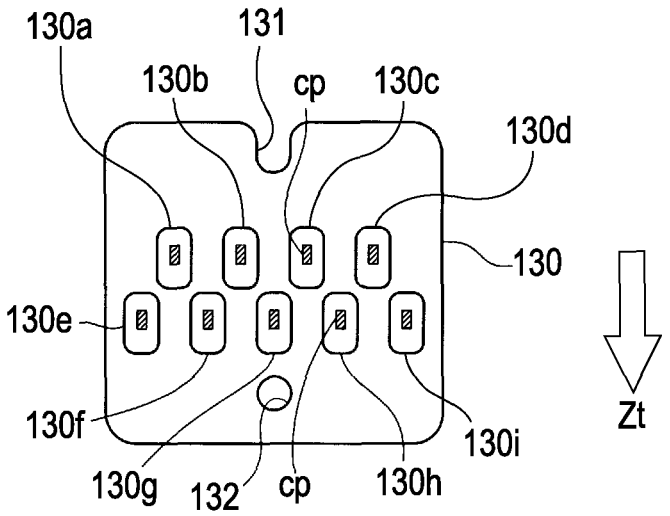
FIGS. 5A and 5B are diagrams for describing a circuit board.
Figure 5B:
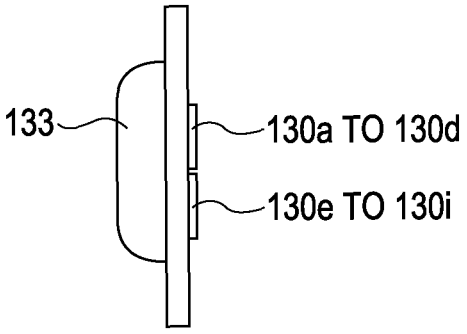

FIGS. 5A and 5B are diagrams for describing the circuit board 130. FIG. 5A shows a configuration of the surface of the circuit board 130. FIG. 5B shows a diagram when the circuit board 130 is viewed from the side surface. The surface of the circuit board 130 is a surface that is exposed to the outside upon being mounted to the cartridge 10. In addition, an arrow Zt shown in FIG. 5A shows the insertion direction of the cartridge 10 into the holder 20.

As shown in FIG. 5A, a boss groove 131 is formed in the upper end portion of the circuit board 130, and a boss hole 132 is formed in the lower end portion of the circuit board 130. The boss groove 131 and the boss hole 132 are used so as to attach the circuit board 130 to the container main body 100.

The circuit board 130 includes a terminal group having nine terminals 130*a* to 130*i* disposed on the surface, and a storage portion 133. The storage portion 133 disposed on the back stores information (for example, quantity of ink remaining or ink color) on ink of the cartridge 10. The terminals 130*a* to 130*i* are formed in an approximately rectangular shape, and are disposed so as to form two rows approximately perpendicular to the insertion direction Zt. Among the two rows, the row situated inside the insertion direction Z, that is, in the lower side in FIG. 5A is called a lower row (a first row), and the row situated on the front side of the insertion direction Z, that is, on the upper side in FIG. 5A is called an upper row (a second row).

In middle portions of the respective terminals 130*a* to 130*i*, a contact portion cp is included which comes into contact with the respective corresponding terminals among the apparatus side terminal mounted to the holder 20. Each contact portion cp of the terminals 130*a* to 130*d* forming the upper row and each contact portion cp of the terminals 130*e* to 130*i* forming the lower are alternately disposed and constitute a so-called zigzag arrangement. Furthermore, the terminals 130*a* to 130*d* forming the upper row and the terminals 130*e* to 130*i* forming the lower row are also alternately disposed and constitute a zigzag arrangement so that the mutual terminal centers are not aligned in the insertion direction Zt. Furthermore, the circuit board 130 is attached to the cartridge 10 so as to include many terminals as much as the row close to the notch 140 of the cartridge 10. That is, the circuit board 130 is attached to the cartridge 10 so that the lower row (the first row) is the lower position in regard to the height direction of the cartridge 10 than the upper row (the second row).

The terminals 130*a* to 130*d* forming the upper row and the terminals 130*e* to 130*i* forming the lower row have the following functions (applications), respectively.

<Upper Row>

(1) Mounting Detection Terminal 130*a*

(2) Reset Terminal 130*b*

(3) Clock Terminal 130*c*

(4) Mounting Detecting Terminal 130*d*

<Lower Row>

(5) Mounting Detection Terminal 130*e*

(6) Power Source Terminal 130*f*

(7) Earth Terminal 130*g*

(8) Data Terminal 130*h*

(9) Mounting Detection Terminal 130*i*

Four mounting detection terminals 130*a*, 130*d*, 130*e*, and 130*i* are used so as to detect if the electrical contact with the apparatus side terminal is good or bad and can also be referred to as a "contact detection terminal". The other five terminals 130*b*, 130*c*, 130*f*, 130*g*, and 130*h* are terminals for the storage portion 133.

A-3. Holder Configuration

Figure 6A:
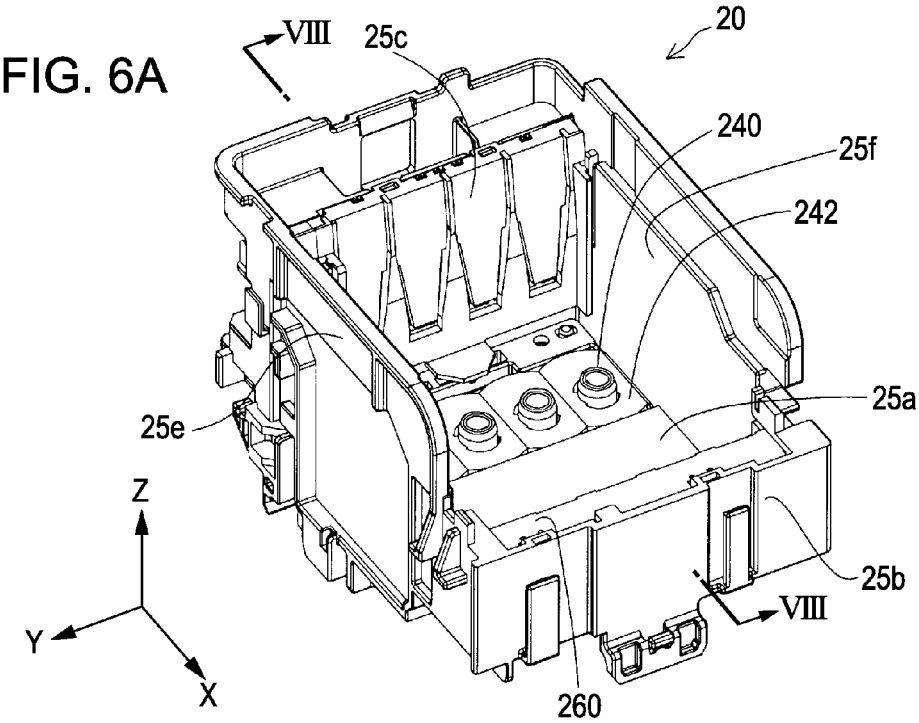
FIGS. 6A and 6B are diagrams for describing a holder.
Figure 6B:
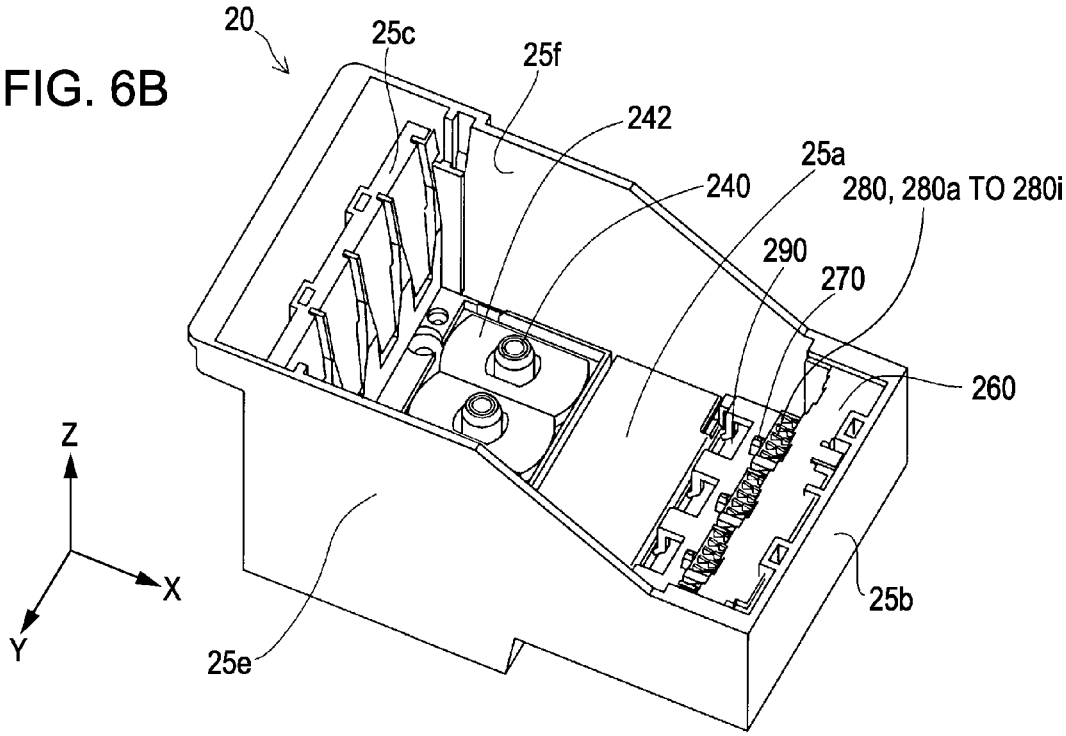
Figure 7A:
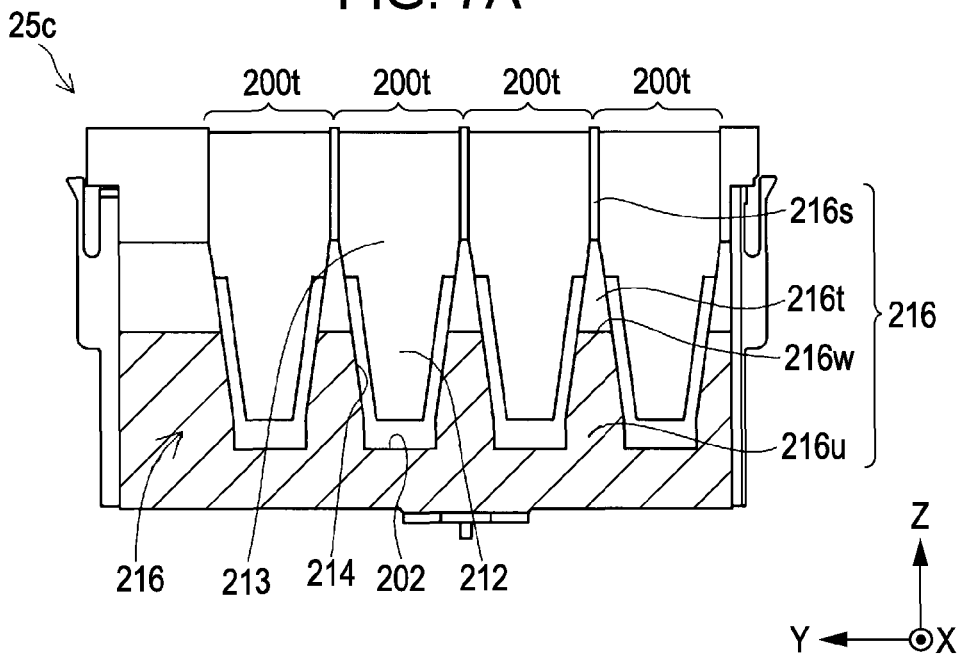
FIGS. 7A and 7B are diagrams for describing a detailed configuration of opposite wall surface portions.
Figure 7B:
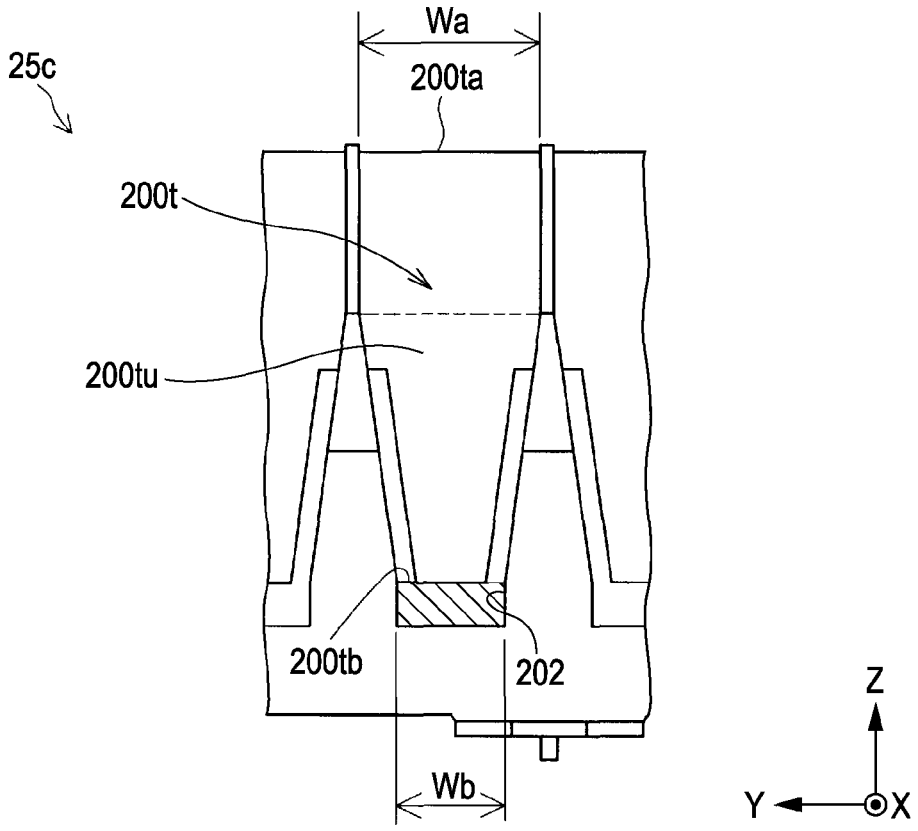
Figure 8:
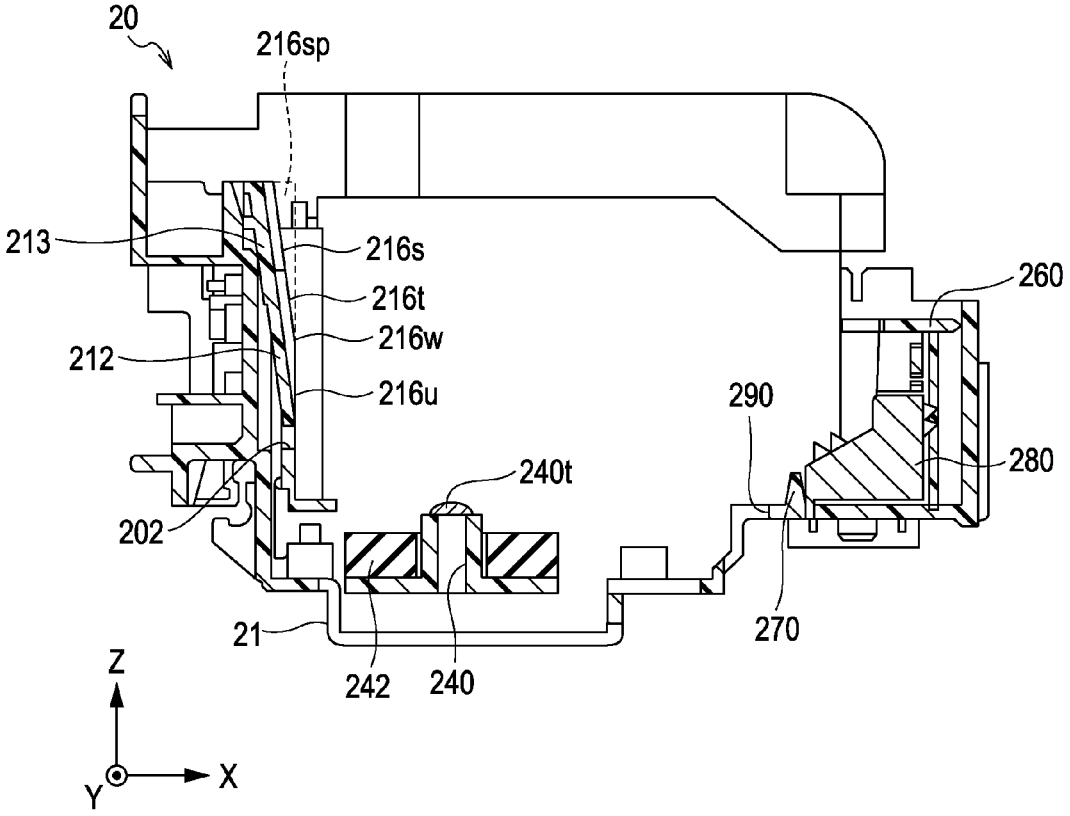
FIG. 8 is a cross-sectional diagram taken from the line VIII-VIII of FIG. 6A.

Next, the detailed configuration of the holder 20 will be described using FIGS. 6A to 8. FIGS. 6A and 6B are diagrams for describing the holder 20. FIG. 6A is a first exterior perspective view of the holder 20, and FIG. 6B is a second exterior perspective view of the holder 20. In addition, in the second exterior perspective view, the outer peripheral wall forming the holder 20 is partially omitted for facilitation of the description. FIGS. 7A and 7B are diagrams for describing the detailed configuration of the opposite wall surface portion 25*c*. FIG. 7A is a diagram in which the opposite wall surface portion 25*c* is viewed from the X positive axis direction side. FIG. 7B is a partially enlarged view of FIG. 7A. FIG. 8 is a cross-sectional view taken from line VIII-VIII of FIG. 6A.

As shown in FIG. 6A, the holder 20 has a concave shape in which a portion is opened so as to make the cartridge 10 attachable or detachable. The holder 20 has an apparatus side wall surface portion (also called a "bottom surface portion") 25*a*, an engagement portion side wall surface portion ("front surface portion") 25*b*, an opposite wall surface portion (also called a "rear surface portion") 25*c*, a first apparatus side side wall surface portion (also called a "left side wall portion") 25*e*, and a second apparatus side side wall surface portion (also called a "right side surface portion") 25*f*. A cartridge accommodation chamber, which is a space for accommodating the cartridge 10, is formed by the wall surface portions 25*a*, 25*b*, 25*c*, 25*e*, and 25*f*. The respective wall surface portions 25*a*, 25*b*, 25*c*, 25*e*, and 25*f* are molded from a synthetic resin such as polypropylene.

The apparatus side bottom wall surface portion 25*a* constitutes the bottom surface in the usage posture of the printer 1. The opposite wall surface portion 25*c*, the engagement portion side wall surface portion 25*b*, the first apparatus side side wall surface portion 25*e*, and the second apparatus side side wall surface portion 25*f* are erected from the apparatus side bottom wall surface portion 25*a*. The opposite wall surface portion 25*c* and the engagement portion side wall surface portion 25*b* are in an opposing relationship with the cartridge accommodation chamber interposed therebetween, and the first apparatus side side wall surface portion 25*e* and the second apparatus side side wall surface portion 25*f* are in an opposing relationship with the cartridge accommodation chamber interposed therebetween.

A liquid supply pipe 240 and a seal member 242 are attached to the apparatus side bottom wall surface portion 25*a*. One end side of the liquid supply pipe 240 is connected to the printing head 21 (FIG. 8) that is attached to a rear surface (a surface of the Z negative axis direction side) of the apparatus side bottom wall surface portion 25*a*. Furthermore, when the cartridge 10 is mounted to the holder 20, the other end side of the liquid supply pipe 240 is connected to the liquid supply port 110 (FIG. 3A) of the cartridge 10. The seal member 242 is a member having elasticity, such as a synthetic rubber. The seal member 242 is disposed around the liquid supply pipe 240 and prevents that ink leaks out to the outside when the cartridge 10 is mounted to the holder 20. Furthermore, as shown in FIG. 8, in the other end side of the liquid supply pipe 240, a porous metallic filter 240*t* is provided which partially comes into contact with the foam 112 (FIG. 4A) in the liquid supply port 110. As the filter 240*t*, for example, a stainless steel mesh or a stainless steel nonwoven fabric can be used. In addition, the filter 240*t* can be omitted.

As shown in FIG. 6B, in the apparatus bottom wall surface portion 25*a*, four through holes 290 (only three through holes are shown in FIG. 6B) and four first apparatus side restriction portions (only three portions are shown in FIG. 6B) are provided corresponding to the number (four) of the cartridge 10 to be mounted. In addition, in the apparatus side bottom wall surface portion 25*a*, four contact mechanisms 280 (only three mechanisms are shown in FIG. 6B) are disposed corresponding to the number of cartridges 10 to be mounted.

The through holes 290 are used in the detection of the quantity of ink remaining of the inner portion of the cartridge 10 due to the use of an optical detection apparatus described later provided on the Z negative axis direction side of the holder 20. Specifically, the through holes 290 transmits light emitted from the optical detection apparatus and transmits light reflected from the cartridge 10.

A shape of the first apparatus side restriction portion 270 is a protrusion shape. Furthermore, the first apparatus side restriction portion 270 has a shape which is pointed as it faces upward. The first apparatus side restriction portion 270, into which the notch 140 as the first restriction portion included in the cartridge 10 is inserted, restricts the movement of the cartridge 10 in the width direction (the Y axis direction). In addition, the first apparatus side restriction portion 270 is also called a restriction pin 270. The restriction pin 270 may be molded integrally with the holder 20 similar to the present embodiment and may be attached to the apparatus side bottom wall surface portion 25*a* as a separate member.

The contact mechanism 280 is used so as to electrically connect the circuit board 130 of the cartridge 10 with the control unit 60 of the printer 1. The contact mechanism 280 has a plurality of electrical contact members (also called a "terminal") 180*a* to 280*i* for coming into contact with the terminals 130*a* to 130*i* of the circuit board 130. The number of electrical contact members 280*a* to 280*i* correspond to that of the terminal 130*a* to 130*i* (FIG. 5A) of the circuit board 130, and is nine in the present embodiment. In addition, the contact mechanism 280 is electrically connected to the control unit 60.

The holder 20 has an apparatus side engagement portion 260 that is disposed adjacent to the engagement portion side wall surface portion 25*b*. The apparatus side engagement portion 260 is in a predetermined height from the apparatus side bottom wall surface portion 25*a*. The apparatus side engagement portion 260 restricts the movement of the cartridge 10 in the height direction upon mounting the cartridge 10 by being engaged with the container side restriction portion 124 (FIG. 3B) of the cartridge 10.

As shown in FIG. 7A, the opposite wall surface portion 25*c* includes an upright wall portion 216, a guide groove 200*t*, and a hole portion 202 formed in the upright wall portion 216. In the usage posture, the upright wall portion 216 is extended upward (the Z positive axis direction) from the apparatus side bottom wall surface portion 25*a*. The upright wall portion 216 has an opposite surface 216*u*, an extension surface 216*t*, and an upper surface 216*s* in order from the lower portion. In the usage posture, the opposite surface 216*u* is extended from the apparatus side bottom wall surface portion 25*a* in the vertical upper direction. In other words, in the mounted state where the cartridge 10 is mounted to the holder 20, the opposite surface 216*u* forms a surface that is approximately parallel with the outer surface of the third wall surface portion 100*c* (FIG. 3A) of the cartridge 10. In order to facilitate understanding, the opposite surface 216*u* has single hatching added thereto.

The extension surface 216*t* is extended from the upper end of the opposite surface 216*u* toward the outside of the holder 20. In other words, in the mounted state, the extension surface 216*t* is extended in a direction away from the outer surface of the third wall surface portion 100*c* (FIG. 3A) of the cartridge 10. In the present embodiment, the extension surface 216*t* constitutes a slope surface which inclines to the vertical direction. Furthermore, the opposite wall surface portion 25*c* has a rotation fulcrum 216*w* corresponding to the rotation fulcrum 166*w* of the cartridge 10. The rotation fulcrum 216*w* is defined by a boundary between the opposite surface 216*u* and the extension surface 216*t*. In other words, the rotation fulcrum 216*w* is also called an upper end of the opposite surface 216*u*.

The upper surface 216*s* is extended upward from the lower end of the extension surface 216*t* in the usage posture of the printer 1. Similar to the extension surface 216*t*, the upper surface 216*s* also inclines to the vertical direction.

As shown in FIG. 8, by forming the opposite surface 216*u*, the extension surface 216*t*, and the upper surface 216*s*, a space portion 216*sp* is formed which is able to accommodate a portion of the cartridge 10 when detaching the cartridge 10 while rotating.

The description continues back to FIGS. 7A and 7B. A protrusion portion 160 (FIG. 3A) of the cartridge 10 is inserted into the approximately rectangular-shaped hole portion 202. As a result, in the mounted state, the movement of the cartridge 10 relative to the holder 20 in the width direction (the Y axis direction) and the height direction (the Z axis direction) is restricted within a predetermined range. In addition, it is desirable that the width Wb of the hole portion 202 be approximately the same as the width Wt of the protrusion portion 160 of the cartridge 10. In this manner, it is possible to further reduce (restrict) the movement of the cartridge 10 in the width direction after the protrusion portion 160 is inserted into the hole portion 202. Herein, the expression "approximately the same" means that the width Wb of the hole portion 202 is slightly greater than the width Wt of the protrusion portion 160 to the extent that the protrusion portion 160 can be inserted into the hole portion 202. For example, it is desirable that the width Wb be greater than the width Wt and be equal to or less than 1.2 times the width Wt.

The guide groove 200*t* guides the protrusion portion 160 to the hole portion 202 while restricting the movement of the cartridge 10 in the width direction when the cartridge 10 is mounted to the holder 20. As shown in FIG. 7B, the guide groove 200*t* is formed from the upper end from the opposite wall surface portion 25*c* over the hole portion 202. In other words, in the usage posture of the holder 20, the guide groove 200*t* is extended upward from the hole portion 202, and the upper end thereof reaches the upper end of the opposite wall surface portion 25*c*. In addition, in order to facilitate the description, in FIG. 7B, the hole portion 202 has single hatching added thereto. By providing the guide groove 200*t*, since there is no need to provide another member such as a partition wall for positioning the cartridge 10 in the holder 20, the holder 20 can be reduced in size.

The width Wa of the upper end 200*ta* of the guide groove 200*t* is greater than the width Wb of the lower end 200*tb*. In addition, the width Wa of the upper end 200*ta* is greater than the width Wt (FIG. 3C) of the protrusion 160 of the cartridge 10. Furthermore, the lower end 200*tb* has the same width as that of the hole portion 202. That is, the lower end 200*tb* of the guide groove 200*t* forms the upper end of the hole portion 202.

Furthermore, the width of the guide groove 200*t* is monotonically reduced as it approaches the lower end 200*tb* (that is, the hole portion 202) from the upper end 200*ta*. More specifically, the guide groove 200*t* has a taper-shaped lower guide groove 200*tu* in which the width is gradually reduced as it approaches the hole portion 202. Herein, the expression "monotonically reduced" means that a regular width portion may be included if a portion is not included in which the width is increased as it approaches the lower end 200*tb* from the upper end 200*ta*. In addition, the boundary between the lower guide groove 200*tu* and other portions has dashed lines added.

As shown in FIGS. 7A and 8, furthermore, the opposite wall surface portion 25*c* has a deformation portion 212 which can be elastically deformed in a depth direction (the X axis direction, a direction where the apparatus side engagement portion 260 faces the opposite wall surface portion 25*c*) of the guide groove 200*t*. In other words, the deformation portion 212 is configured so as to be elastically deformable toward the outside of the cartridge accommodation chamber accommodating the cartridge 10. The deformation portion 212 is formed by forming notches 214 in both ends of the groove bottom wall surface portion 213 constituting the bottom surface of the guide groove 200*t*. The notches 214 penetrate through the groove bottom wall surface portion 213. As a result, the guide groove 200*t* can be easily formed. The deformation portion 212 is extended to a height equal to or greater than a predetermined height from the portion coming into contact with the hole portion 202 among the portions of the groove bottom wall surface portion 213. The predetermined height refers to a height at which an intersection point, where the rotation trajectory of the protrusion portion 160 (FIG. 4A) intersects the groove bottom wall surface portion 213, is situated when mounting the cartridge 10 by a predetermined method (an "engagement mounting method" described later). In addition, the detail will be described later.

A-4. Attachment of Cartridge

Figure 9A:
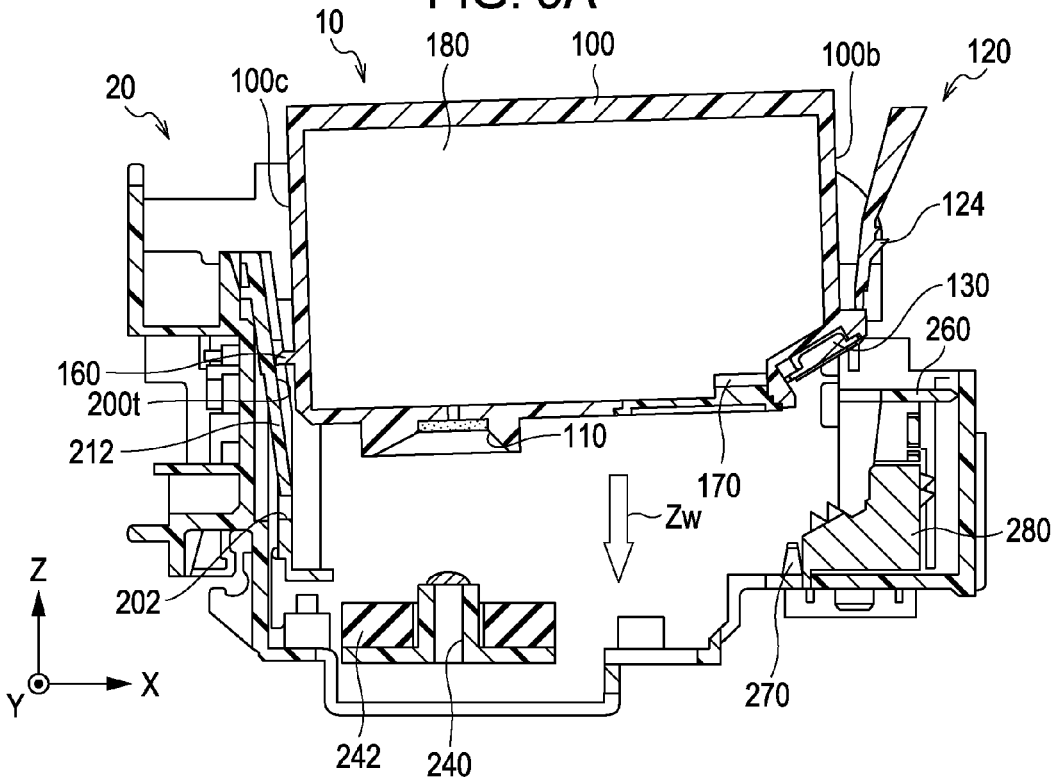
FIGS. 9A and 9B are diagrams for describing a state of attaching a cartridge.
Figure 9B:
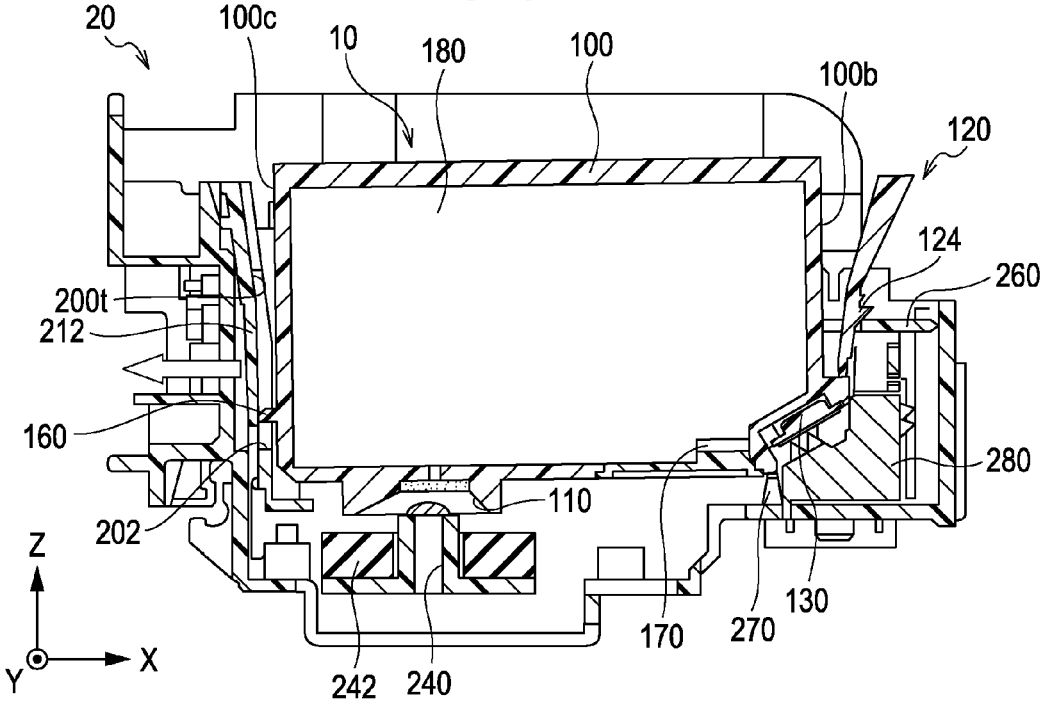

FIGS. 9A and 9B are diagrams for describing the state of attaching the cartridge 10 to the holder 20. FIG. 9A is a first diagram showing the attaching state, and FIG. 9B is a second diagram showing the attaching state. FIGS. 9A and 9B are diagrams that show the cross-section IX-IX of the cartridge 10 of FIG. 3B and the cross-section of the holder 20 corresponding to the cross-section IX-IX. Hereinafter, a mounting method (a normal mounting method) will be described which is commonly adopted when a user mounts the cartridge 10 to the holder 20.

In the normal mounting method, as shown in FIG. 9A, the cartridge 10 is tilted so that the protrusion portion 160 (specifically, a tip surface 160*c* (FIG. 3A)) of the third wall surface portion 100*c* comes into contact with the opposite wall surface portion 25*c*, and the cartridge 10 is mounted to the holder 20. Specifically, the cartridge 10 is moved vertically downward as shown by an arrow Zw while inserting the protrusion portion 160 into the guide groove 200*t*. At this time, since the width Wa of the upper end of the guide groove 200*t* is greater than the width Wt of the protrusion portion 160 of the cartridge 10, the protrusion portion 160 can be easily inserted into the guide groove 200*t*.

As shown in FIG. 9B, when the protrusion portion 160 of the cartridge 10 is move to the position coming into contact with the deformation portion 212 and the external force is applied by the protrusion portion 160, the deformation portion 212 is elastically deformed toward the outside (the X negative axis direction). In this manner, the deformation portion 212 is elastically deformed, it is possible to smoothly mount the cartridge 10 to the holder 20.

Figure 10A:
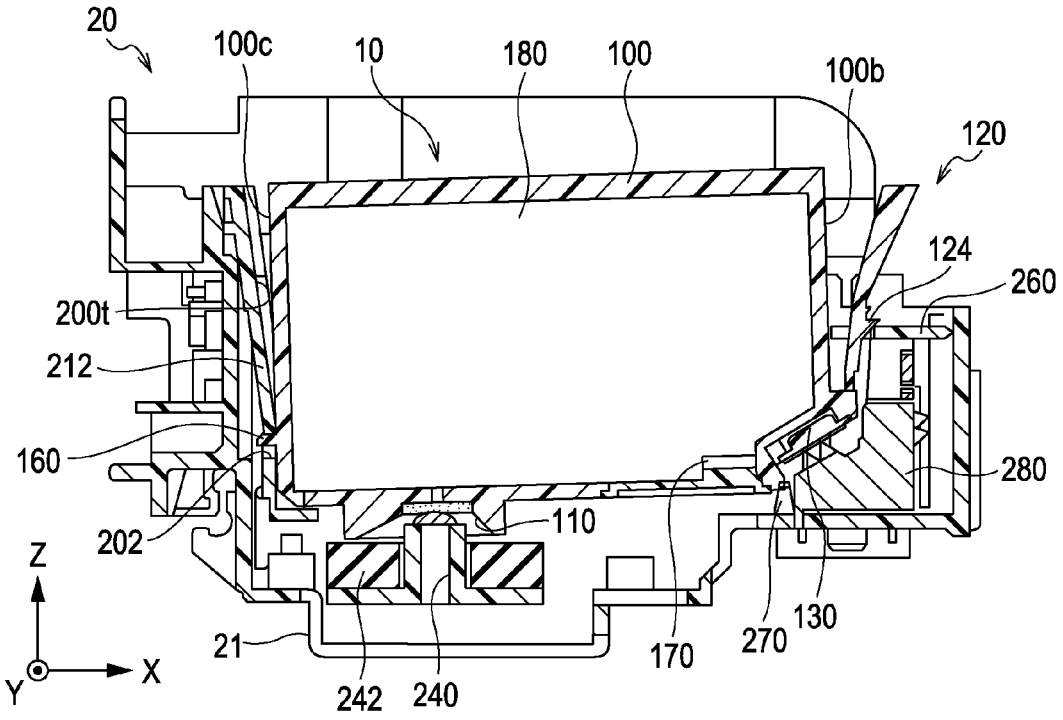
FIGS. 10A and 10B are second diagrams for describing a state of attaching a cartridge.
Figure 10B:
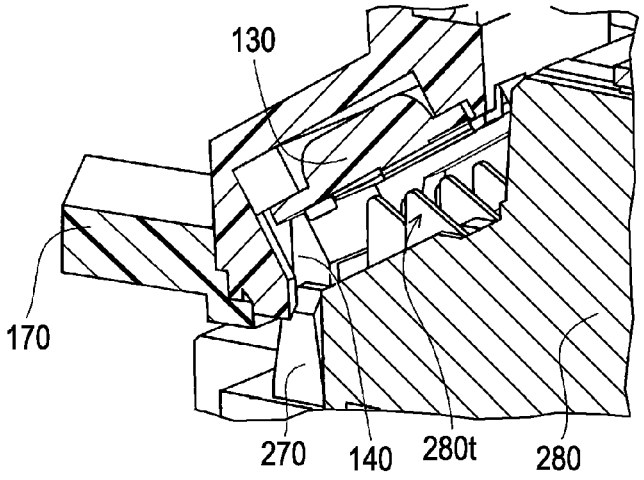

FIGS. 10A and 10B are second diagrams for describing the state of attaching the cartridge to the holder. Similar to FIGS. 9A and 9B, FIG. 10A shows cross-section XA-XA of the cartridge 10 of FIG. 3B and a cross-section of the holder 20 corresponding to the cross-section XA-XA. Furthermore, FIG. 10B is a perspective view near the restriction pin 270 of FIG. 10A.

As shown in FIG. 10A, when the cartridge 10 is further moved vertically downward, the cartridge 10 is guided to the guide groove 200*t* and the protrusion portion 160 is easily inserted into the hole portion 202. In this state, the container side restriction portion 124 of the cartridge 10 is not engaged with the apparatus side engagement portion 260 of the holder 20.

When the protrusion portion 160 is inserted into the hole portion 202, as shown in FIG. 10B, the restriction pin 270 of the holder 20 is inserted into the notch 140 of the cartridge 10. In this state, by pressing the second wall surface portion 100*b* side vertically downward, the container side restriction portion 124 is engaged with the apparatus side engagement portion 260. During a pressing operation, since the movement of the second wall surface portion 100*b* side with the circuit board 130 mounted thereon in the width direction is restricted, it is possible to accurately perform the positioning of the cartridge 10 relative to the holder 20. That is, it is possible to reduce the possibility of the respective terminals 130*a* to 130*i* (FIGS. 5A and 5B) of the circuit board 130 of the cartridge 10 and the apparatus side terminal 280*t* (although there are nine terminals, collectively called apparatus terminal 280*t*) of the contact mechanism 280 entering the non-contact state after mounting.

As mentioned above, since the guide groove 200*t* is formed in the opposite wall surface portion 25*c*, it is possible to easily guide the protrusion portion 160 to the hole portion 202, which can improve the operability upon attaching the cartridge 10 to the holder 20. Furthermore, there is no need to provide a partition wall for restricting the movement of the cartridge 10 in the width direction to mount the cartridge 10 in the correct position in the holder 20. That is, it is possible to improve the operability upon attaching the cartridge 10 to the holder 20 while promoting a reduction in size of the holder 20. Furthermore, since the guide groove 200*t* has a lower guide groove 200*tu*, it is possible to further smoothly guide the protrusion portion 160 to the hole portion 202.

Figure 11A:
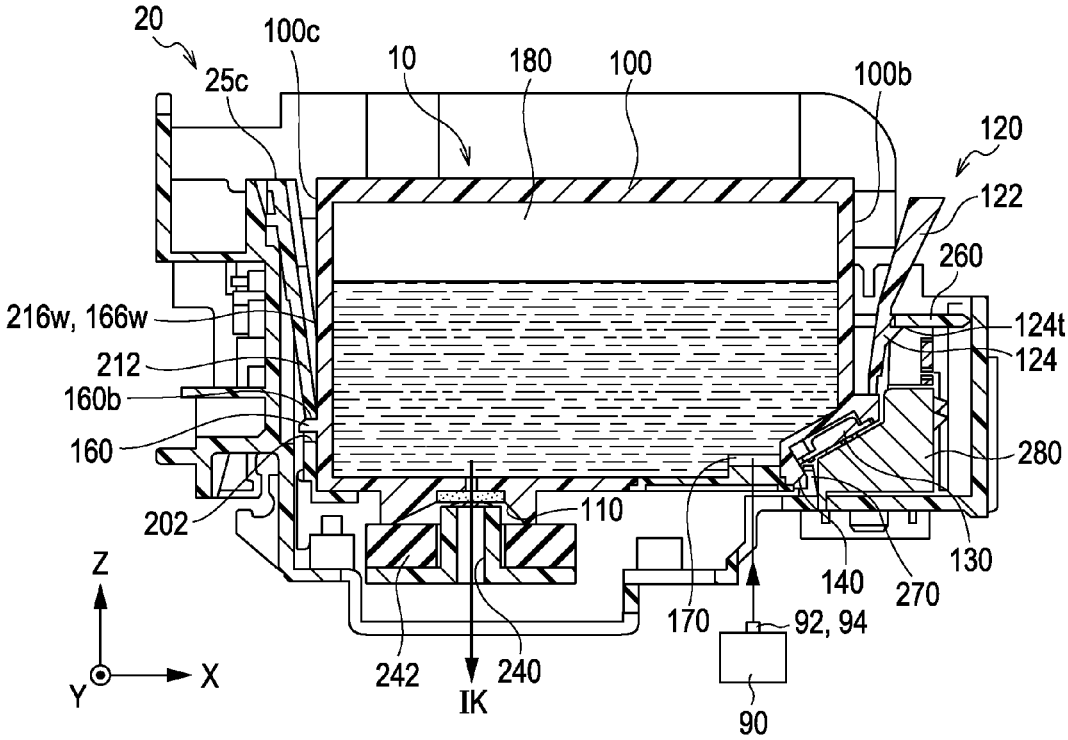
FIGS. 11A and 11B are diagrams for describing the state after mounting.
Figure 11B:
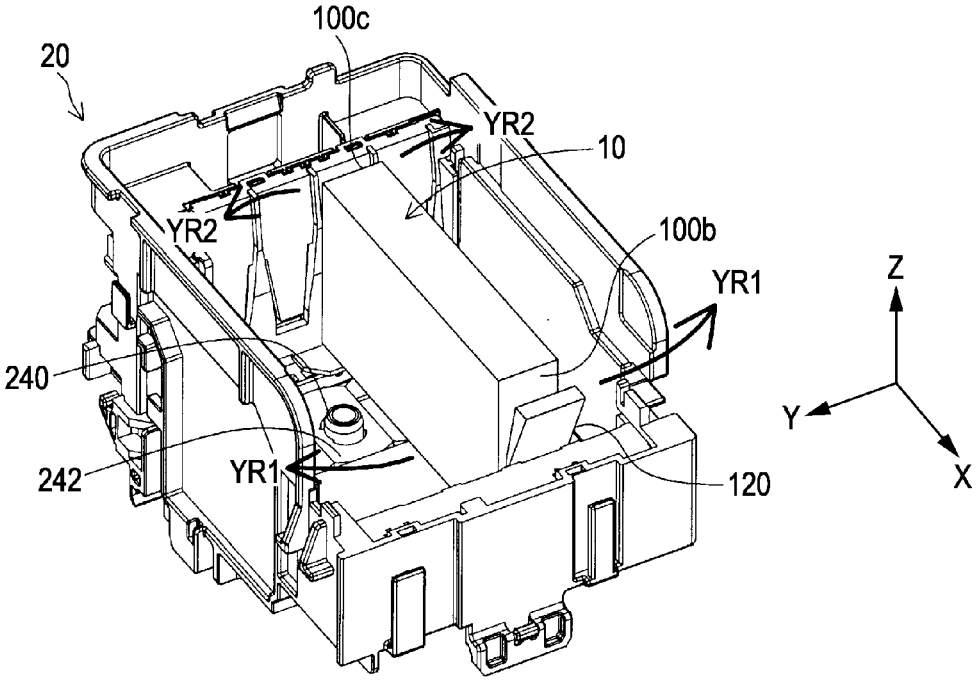

FIGS. 11A and 11B are diagrams for describing the state after the mounting. Similar to FIGS. 9A and 9B, FIG. 11A shows the cross-section XIA-XIA of the cartridge 10 of FIG. 3B and the cross-section of the holder 20 corresponding to the cross-section XIA-XIA. FIG. 11B is a perspective view of the mounted state. In FIG. 11A, ink accommodated in the liquid accommodation chamber 180 is shown by dot.

As shown in FIG. 11A, in the mounted state, the container side restriction portion 124 is engaged with the apparatus side engagement side 260, whereby the movement of the cartridge 10 in the height direction is restricted. Herein, in regard to the vertical direction (the Z axis direction) in the usage posture of the holder 20, the rotation fulcrum 216*w* is situated in the lower portion than the engagement point 124*t*. In the mounted state, the lever 120 is engaged with the apparatus side engagement portion 260 in the state of approaching the second wall surface portion 100*b* further than the unloaded state. Thus, the lever 120 presses the container main body 100 against the opposite wall surface portion 25*c*, whereby the movement of the cartridge 10 in the length direction (the X axis direction). Furthermore, in the mounted state, the liquid supply pipe 240 is connected to the liquid supply port 110. Furthermore, each terminal of the circuit board 130 comes into contact with the respective corresponding electrical contact members 280*a* to 280*i* of the contact mechanism 280 and transmits various information such as ink color or quantity of ink remaining information between the cartridge 10 and the control unit 60 (FIG. 1) of the printer 1. In addition, the quantity of ink remaining is detected by the use of the optical detection apparatus 90 at a predetermined timing. Furthermore, in the mounted state, ink is supplied to the printing head 21 via the liquid supply port 110 and the liquid supply pipe 240 by the absorption from the printing head 21.

In the mounted state, the movement of the cartridge 10 is restricted mainly by the hole portion 202 of the holder 20, the apparatus side engagement portion 260, and the restriction pin 270. Specifically, the hole portion 202 and the protrusion portion 160 cooperate with each other to restrict the movement of the third wall surface portion 100*c* side in the width direction (the Y axis direction) and the height direction (the Z axis direction), the apparatus side engagement portion 260 and the container side restriction portion 124 cooperate with each other to restrict the movement of the second wall surface portion 100*b* side in the height direction, and the restrict pin 270 and the notch 140 cooperate with each other to restrict the movement of the second wall surface portion 100*b* side in the width direction.

In the mounted state, the upper surface 160*b* of the protrusion portion 160 are in contact with the hole portion 202. As a result, it is possible to restrict the upward movement (the Z positive axis direction) of the cartridge 10 after the cartridge 10 is mounted to the holder 20.

Herein, upon performing the printing or the like, the holder 20 and the cartridge 10 are moved in the main scanning direction (the Y axis direction, the width direction of the cartridge 10). That is, the cartridge 10 receives an external force (inertial force) of the width direction. The cartridge 10 receives the external force, whereby, as shown in FIG. 11B, the cartridge 10 is rotated around the liquid supply port 110 (FIG. 11A) in the rotation direction including the width direction component.

Specifically, the portion of the second wall surface portion 100*b* side is rotated toward an arrow YR1, and the portion of the third wall surface portion 100*c* side is rotated toward an arrow YR2.

The movement of the third wall surface portion 100*c* side in the arrow YR2 direction including the width direction component is restricted by the cooperation of the protrusion portion 160 with the hole portion 202. Specifically, the first and second side surfaces 160*e* and 160*f* (FIG. 3C) of the protrusion portion 160 come into contact with the hole portion 202, whereby the movement of the cartridge 10 in the width direction relative to the holder 20 is restricted.

The movement of the second wall surface portion 100*b* side in the arrow YR1 direction including the width direction component is restricted by the cooperation of the notch 140 with the restriction pin 270. The circuit board 130 is provided in the second wall surface portion 100*b*. Thus, by providing the notch 140 for restricting the movement of the second wall surface portion 100*b* side in the width direction in the second wall surface portion 100*b*, it is possible to restrict the movement (deviation) of the circuit board 130 relative to the holder 20 compared to providing the notch 140 in the first wall surface portion 100*a*. As a result, it is possible to satisfactorily maintain the electric connection between the circuit board 130 and the printer 1 after the mounting. Particularly, in the present embodiment, as mentioned above, the circuit board 130 is disposed so as to partially overlap with the notch 140 in the length direction (FIG. 3A). Thus, it is possible to suppress to a minimum the movement (deviation) of the circuit board 130 relative to the holder 20.

Furthermore, when a groove for restricting the movement in the width direction is provided in the first wall surface portion 100*a* (the bottom surface), a member for forming (defining) the groove is required therearound. In the present embodiment, since the notch 140 restricting the movement in the width direction is provided in the second wall surface portion 100*b*, it is possible to reduce the size of the cartridge 10 in the length direction (the X axis direction).

Furthermore, the notch 140 can suppress (restrict) the movement of the prism 170 in the width direction by cooperating with the restriction pin 270. Particularly, in the present embodiment, the prism 170 is disposed in contact with the inner surface of the second wall surface portion 100*b* formed with the notch 140 (FIG. 4A). As a result, it is possible to suppress the movement (deviation) of the prism 170 in the width direction to a minimum, which can accurately perform the detection of the quantity of ink remaining. In addition, it is possible to reduce the possibility of the flow of ink directed to the liquid supply port 110 being dammed by the prism 170. As a result, it is possible to effectively consume ink within the liquid accommodation chamber 180, thereby reducing the quantity of ink remaining.

Furthermore, by forming the first restriction portion as the notch 140, as compared to the case where the first restriction portion is a protrusion shape (in this case, the first apparatus side restriction portion 270 enters a concave state), it is possible to reduce the possibility of the first restriction portion (the notch 140) interfering with the holder 20 upon attaching or detaching the cartridge 10 to or from the holder 20. As a result, it is possible to suppress the occurrence of an inconvenience, such as a breakdown of the cartridge 10 or the holder 20.

In this manner, since the cartridge 10 has the notch 140 for restricting the movement of the second wall surface portion 100*b* with the circuit board 130 mounted thereon in the width direction, it is possible to suppress (restrict) the deviation of the circuit board 130 relative to the holder 20. Thus, it is possible to reduce the possibility that the electric connection between the circuit board 130 with the printer 1 being shut off. Furthermore, since the deviation of the circuit board 130 relative to the holder 20 can be suppressed, many terminals can be provided by the circuit board 130. As a result, it is possible to perform the transmission of more information between the circuit board 130 and the printer 1.

A-5. Attachment of Cartridge by Another Method

Figure 12A:
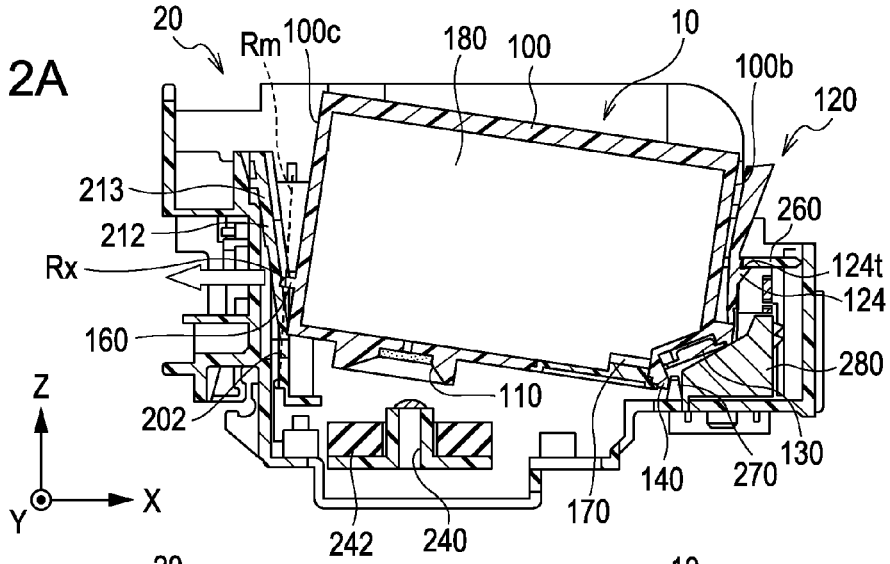
FIGS. 12A to 12C are diagrams for describing an attachment method of another method.
Figure 12B:
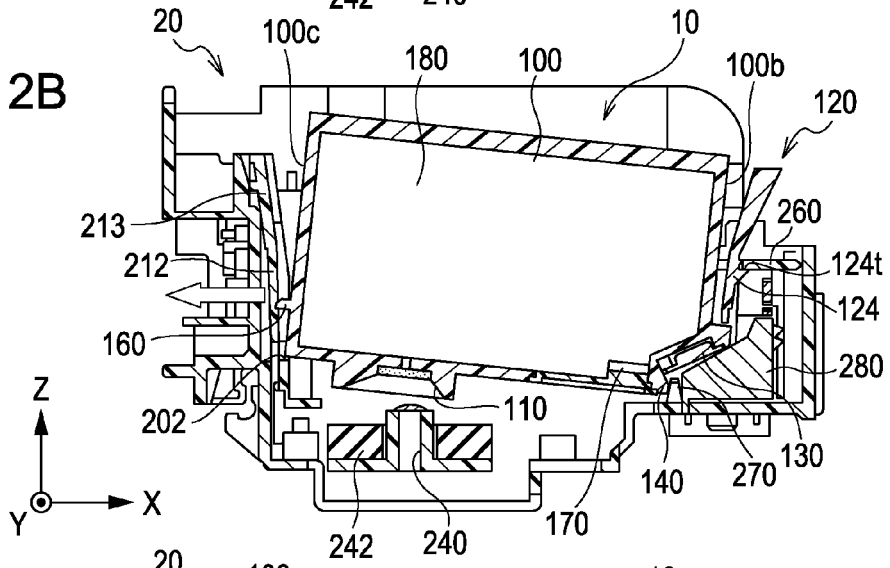
Figure 12C:
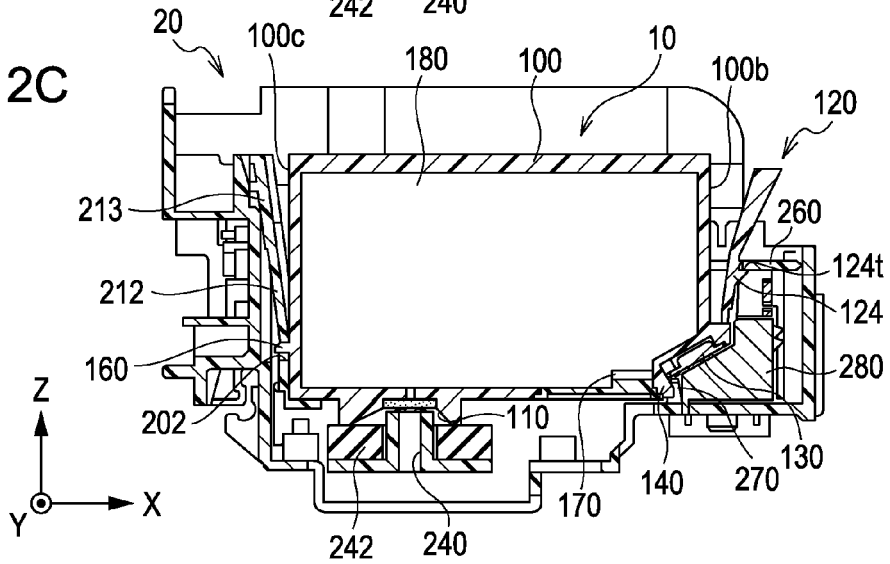

FIGS. 12A to 12C are diagrams for describing an attachment method of another method. The time series is shown in the order of FIGS. 12A to 12C. Furthermore, FIGS. 12A to 12C are diagrams showing the cross-section XII-XII of the cartridge 10 of FIG. 3B, and the cross-section of the holder 20 corresponding to the cross-section XII-XII. A mounting method (an engagement mounting method) of titling and inserting the cartridge 10 into the holder 20 such that the second wall surface portion 100*b* is situated further downward vertically than the third wall surface portion 100*c* will be described by the use of FIGS. 12A to 12C.

As shown in FIG. 12A, in the engagement mounting method, before the protrusion portion 160 is inserted into the hole portion 202, the container side restriction portion 124 is engaged with the apparatus side engagement portion 260. In this case, by rotating the cartridge 10 using the engagement point 124*t* as the rotation fulcrum, the cartridge 10 is mounted to the holder 20. At this time, the protrusion portion 160 draws a rotation trajectory Rm. The rotation trajectory Rm intersects the deformation portion 212. That is, the deformation portion 212 is situated in the point where the rotation trajectory Rm intersects the holder 20. In other words, in the usage posture, the deformation portion 212 is formed so as to reach the position higher than the intersection point Rx where the rotation trajectory Rm intersects the groove bottom wall surface portion 213, among the groove bottom wall surface portion 213. As shown in FIG. 14A, in the state immediately after the protrusion portion 160 comes into contact with the groove bottom wall surface portion 213, the protrusion portion 160 comes into contact with the deformation portion 212.

As shown in FIG. 12B, when pushing the third wall surface portion 100*c* side in the vertical down direction, the deformation portion 212 is pushed in the outer direction (the X negative axis direction) of the holder 20 by the protrusion portion 160 and is elastically deformed. It is possible to push the third wall surface portion 100*c* side in the vertical down direction without limiting the movement of the cartridge 10, owing to the elastic deformation of the deformation portion 212. As a result, as shown in FIG. 12C, the cartridge 10 can be mounted to the holder 20.

As mentioned above, since the holder 20 has the deformation portion 212, it is possible to reduce the possibility of the movement of the cartridge 10 within the holder 20 before the cartridge 10 being mounted to the holder 20. As a result, since there is no need to provide a mechanism prohibiting a specific mounting method in the opening of the holder 20, it is possible to improve the operability upon attaching the cartridge 10 to the holder 20 while promoting a reduction in number of the components of the holder 20. That is, a user can mount the cartridge 10 to the holder 20 using various mounting methods such that the mounting method is not limited.

B. Second Embodiment

Figure 13:
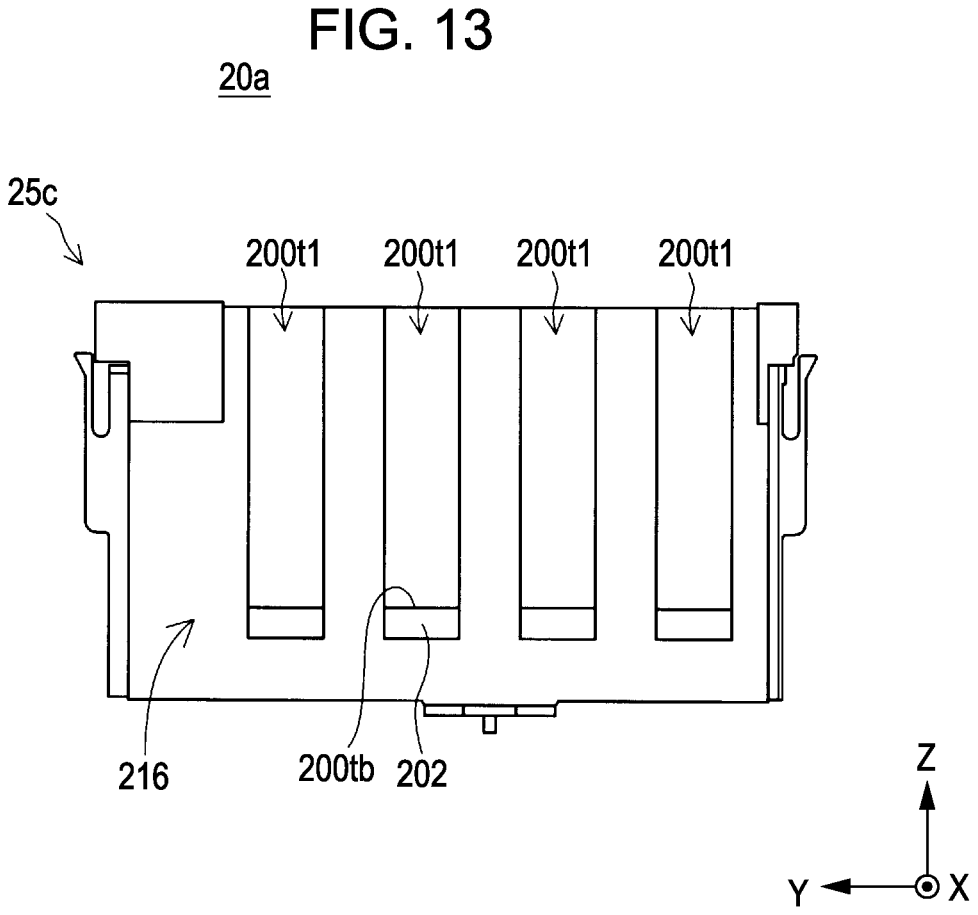
FIG. 13 is a diagram for describing a holder of a second embodiment.

FIG. 13 is a diagram for describing a holder 20*a* of a second embodiment. FIG. 13 is a diagram in which the opposite wall surface portion 25*c* is viewed from the X positive axis direction side. Since the holder 20*a* of the second embodiment is different from the holder 20 (FIGS. 6A, 6B, 7A and 7B) of the first embodiment in the configuration of the guide grooves 200*t* and 200*t*1 and other configurations are the same as those of the first embodiment, the same configurations are denoted by the same reference numerals and the descriptions thereof will be omitted. Furthermore, the configuration of the cartridge 10 (FIGS. 3A to 3D and 4A to 4C) to be mounted to the holder 20*a* or the printer 1 (FIG. 1) provided with the holder 20*a* is the same as that of the first embodiment.

The opposite wall surface portion 25*c* of the holder 20*a* includes an upright wall portion 216, a guide groove 200*t*1, and a hole portion 202 formed in the upright wall portion 216. The guide groove 200*t*1 is formed from the upper end of the opposite wall surface portion 25*c* over the hole portion 202. In other words, the guide groove 200*t*1 is extended upward from the hole portion 202, and the upper end thereof reaches the upper end of the opposite wall surface portion 25*c*. The guide groove 200*ta* has a regular width from the upper end to the lower end. Furthermore, the guide groove 200*t*1 has the same width as the hole portion 202. In addition, unlike the first embodiment, the opposite wall surface portion 25*c* of the second embodiment does not have the deformation portion 212, but may have the deformation portion 212 by the notch or the like.

As mentioned above, since the holder 20*a* of the second embodiment has the guide groove 200*t*1 like the first embodiment, it is possible to easily guide the protrusion portion 160 (FIG. 3A) of the cartridge 10 to the hole portion 202. Furthermore, the guide groove 200*t*1 of the holder 20*a* is extended straight upward from the hole portion 202 in the usage posture of the holder 20*a* and has the same width as that of the hole portion 202. As a result, once the protrusion portion 160 is inserted into the guide groove 200*t*1, it is possible smoothly guide the protrusion portion 160 up to the hole portion 202 compared to the first embodiment.

C. Modified Example

In addition, elements other than the elements described in the independent claim of the claims are additional elements and can be suitably omitted. Furthermore, the invention is not limited to the above embodiments, but can be carried out in various forms within the scope not departing from the gist, and can be modified, for example, as below.

C-1. First Modified Example

In the above embodiment, the guide grooves 200*t* and 200*t*1 were formed from the upper end of the opposite wall surface portion 25*c* over the hole portion 202, but the invention is not limited thereto. The upper ends of the guide grooves 200*t* and 200*t*1 may be formed between the hole portion 202 and the upper end of the opposite wall surface portion 25*c* in regard to the height direction of the opposite wall surface portion 25*c*. Even in this case, by inserting the protrusion portion 160 into the guide groove, it is possible to easily guide the protrusion portion 160 up to the hole portion 202, which can improve the operability upon attaching the cartridge 10 to the holder 20.

C-2. Second Modified Example

In the above first embodiment, although the guide groove 200*t* has the deformation portion 212 (FIG. 7A), the deformation portion 212 may not be included. Even in this case, it is possible to guide the protrusion portion 160 to the hole portion 202 by the guide groove 200*t*. Furthermore, the deformation portion 212 was formed by forming the notches on both sides of the groove bottom wall surface portion 213, but the invention is not limited thereto. For example, among the portions of the opposite wall surface portion 25*c*, a portion to be the deformation portion 212 may be formed by an elastic member having elasticity, such as a rubber. For example, among the groove bottom wall surface portion 213 (FIG. 7A), the portion to be the deformation portion 212 is formed by the elastic member. Even in this case, since the deformation portion 212 has elasticity, it is possible to reduce the possibility of the movement of the cartridge 10 being limited within the holder 20 before the cartridge 10 is mounted to the holder 20.

C-3. Third Modified Example

In the first embodiment, a part of the guide groove 200*t* was configured by the taper-shaped lower guide groove 200*tu*, but all of the guide groove 200*t* may have the taper shape in which the width is gradually reduced from the upper end to the lower end. Furthermore, the guide groove 200*t* may have a shape in which the width is reduced in a step-wise manner (step shape) as facing from the upper end to the lower end. Even in this case, it is possible to easily guide the protrusion portion 160 to the hole portion 202 by the guide groove 200*t*.

C-4. Fourth Modified Example

In the above embodiment, the lower end 200*tb* of the guide grooves 200*t* and 200*t*1 had the same width as that of the hole portion 202 (FIGS. 7B and 13) but may not have the same width, and the width of the lower end 200*tb* may be greater than that of the hole portion 202. Even in this case, similar to the above embodiment, it is possible to easily guide the protrusion portion 160 to the hole portion 202 by the guide grooves 200*t* and 200*t*1.

C-5. Fifth Modified Example

In the above embodiment, although the cartridge 10 had the prism 170 that is used for the detection of the quantity of ink remaining (FIG. 4A), the prism 170 can be omitted. Furthermore, instead of the prism that is used in the optical quantity of ink remaining detection method, a sensor using a piezoelectric element or a sensor using an electrode may be adopted for the quantity of ink remaining. Even in this case, like the above embodiment, the notch 140 of the cartridge 10 cooperates with the restriction pin 270 of the holder 20, whereby it is possible to suppress (restrict) of the movement (deviation) of the circuit board 130 relative to the holder 20.

C-6. Sixth Modified Example

In the above embodiment, although the cartridge 10 has a shape in which the second wall surface portion 100*b* has the first vertical wall portion 100*b*1, the sloping wall portion 100*b*2, and the second vertical wall portion 100*b*3, the shape of the cartridge 10 can adopt an arbitrary shape. For example, the shape of the cartridge 10 may be an approximately rectangular parallelepiped shape which does not have the sloping wall portion 100*b*2 or a shape in which the second wall surface portion 100*b* is uniformly tilted. Furthermore, the respective wall surface portions 100*a* to 100*f* may be tilted at arbitrary angles, and the angle, at which the respective wall surface portions 100*a* to 100*f* intersect each other, may be an angle equal to or greater than 90°. That is, if the liquid accommodation chamber 180 capable of accommodating ink therein can be formed, the ink cartridge 10 is able to adopt an arbitrary shape.

C-7. Seventh Modified Example

In the above embodiment, although the elastic portion (the lever) 120 was provided in the second wall surface portion

100*b* of the cartridge 10, the engagement release portion 122 may be provided on the holder 20 side while forming the container side restriction portion 124 in the second wall surface portion 100*b* of the cartridge 10. Even in this case, the external force is applied to the engagement release portion 122 by a user, whereby it is possible to release the engagement between the holder 20 and the container side restriction portion 124.

C-8. Eighth Modified Example

In the embodiment and the modified examples, although the cartridge 10 used in the printer 1 was described as an example as the liquid accommodation container, the invention can be applied to, for example, a liquid accommodation container that can supply ink to an apparatus such as a liquid crystal display including a color material ejecting head, an apparatus such as an organic EL display and a face emission display (FED) including an electrode material (a conductive paste) ejecting head to be used in forming the electrode, an apparatus including a bio-organic ejecting head used in manufacturing a bio chip, an apparatus including a sample ejecting head as a precision pipette, and a liquid ejecting apparatus such as a printing apparatus or a micro-dispenser, without being limited thereto. Furthermore, the invention can be applied to the holder on which various liquid accommodation containers can be mounted in a freely attachable or detachable manner without being limited to the ink cartridge. When the liquid accommodation container is used in the various liquid ejecting apparatuses, liquid (the color material, the conductive paste, the bio-organic matter or the like) depending on the type of liquid to be ejected by the various liquid ejecting apparatuses may be in the inner portion of the liquid accommodation container.

What is claimed is:

1. A holder to which a liquid accommodation container can be attached or detached, the liquid accommodation container including a front surface portion as one wall surface forming a liquid accommodation chamber for accommodating liquid and a back surface portion facing the front surface as one of the wall surface, and the liquid accommodation container capable of storing liquid to be supplied to the outside, the holder comprising:

an apparatus side engagement portion which is engaged with a container side restriction portion provided in the front surface portion; and an opposite wall surface portion which is disposed in a position facing the apparatus side engagement portion with a space capable of accommodating the liquid accommodation container interposed therebetween, the opposite wall surface portion has a hole portion for inserting a protrusion portion provided in the back surface portion; and a guide groove for guiding the protrusion portion to the hole portion while restricting the movement of the protrusion portion relative to a width direction of the liquid accommodation container when the liquid accommodation container is mounted, the guide groove being extended upward from the hole portion in a usage posture of the holder;

wherein the opposite wall surface portion has a deformation portion which is elastically deformable in a direction in which the apparatus side engagement portion and the opposite wall surface portion face each other, and the deformation portion is formed in a groove bottom wall surface portion forming a bottom surface of the guide groove.

2. The holder according to claim 1, wherein, in the usage posture, an upper end of the guide groove reaches an upper end of the opposite wall surface portion.

3. The holder according to claim 1, wherein, in the usage posture, the width of the upper end of the guide groove is greater than that of a lower end of the guide groove.

4. The holder according to claim 1, wherein the width of the guide groove is monotonically decreased as it approaches the hole portion.

5. The holder according to claim 1, wherein the guide groove has a taper-shaped lower guide groove in which the width is gradually decreased as it approaches the hole portion.

6. The holder according to claim 1, wherein, in the usage posture, the lower end of the guide groove has the same width as that of the hole portion.

7. The holder according to claim 1, wherein the hole portion has approximately the same width as that of the protrusion portion of the liquid accommodation container.

8. The holder according to claim 1, wherein, in the usage posture of the holder, the lower end of the deformation portion reaches the hole portion.

9. The holder according to claim 1, wherein, in the usage posture of the holder, before the protrusion portion of the liquid accommodation container among portions of the groove bottom wall surface portion is inserted into the hole portion, when the container side restriction portion of the liquid accommodation container is engaged with the apparatus side engagement portion, the upper end of the deformation portion reaches a position higher than an intersection point, in which a rotation trajectory of the protrusion portion due to the use of an engagement point, in which the liquid accommodation container is engaged, as a fulcrum, intersects the groove bottom wall surface portion.

10. The holder according to claim 1, wherein the deformation portion is formed by forming notches in both ends of the groove bottom wall surface portion.

11. A liquid accommodation container which is attachable to or detachable from a holder equipped in a liquid ejecting apparatus, the container comprising:

a liquid accommodation chamber that accommodates liquid to be supplied to the liquid ejecting apparatus;

a front surface portion that forms a wall surface of the liquid accommodation chamber; and a back surface portion that forms a wall surface of the liquid accommodation chamber and faces the front surface portion, wherein the front surface portion is provided with a container side restriction portion that is engaged with the holder, and the back surface portion is provided with a protrusion portion which is inserted into a hole portion provided in the opposite wall surface portion of the holder, the protrusion portion being guided by a guide groove provided in the holder for being guided to the hole portion while restricting the movement of a width direction and being inserted into the hole portion;

wherein the opposite wall surface portion of the holder has a deformation portion which is elastically deformable in a direction in which the front surface portion and the opposite wall surface portion face each other, and the deformation portion is formed in a groove bottom wall surface portion forming a bottom surface of the guide groove.

12. The liquid accommodation container according to claim 11, wherein, in the mounted state of being mounted to the holder, an upper surface of the protrusion portion comes into contact with the hole portion.

13. The liquid accommodation container according to claim 11, wherein, in the mounted state of being mounted to the holder, the protrusion portion restricts the movement of the liquid accommodation container relative to the holder in the width direction by cooperating with the hole portion.

14. A liquid ejecting apparatus comprising:

the holder according to claim 1;

the liquid accommodation container mounted to the holder according to claim 11; and a head which is provided with liquid accommodated in the liquid accommodation container and ejects the liquid toward the outside.

15. A liquid ejecting apparatus comprising:

the holder according to claim 2;

the liquid accommodation container mounted to the holder according to claim 11;

and a head which is provided with liquid accommodated in the liquid accommodation container and ejects the liquid toward the outside.

16. A liquid ejecting apparatus comprising:

the holder according to claim 3;

the liquid accommodation container mounted to the holder according to claim 11; and a head which is provided with liquid accommodated in the liquid accommodation container and ejects the liquid toward the outside.

17. A liquid ejecting apparatus comprising:

the holder according to claim 4;

the liquid accommodation container mounted to the holder according to claim 11; and a head which is provided with liquid accommodated in the liquid accommodation container and ejects the liquid toward the outside.

18. A liquid ejecting apparatus comprising:

the holder according to claim 5;

the liquid accommodation container mounted to the holder according to claim 11; and a head which is provided with liquid accommodated in the liquid accommodation container and ejects the liquid toward the outside.

19. A liquid ejecting apparatus comprising:

the holder according to claim 6;

the liquid accommodation container mounted to the holder according to claim 11; and a head which is provided with liquid accommodated in the liquid accommodation container and ejects the liquid toward the outside.

* * * * *